US009689216B2

(12) United States Patent
Robichaux et al.

(10) Patent No.: US 9,689,216 B2
(45) Date of Patent: Jun. 27, 2017

(54) METHOD AND APPARATUS FOR AUTOMATED CONNECTION OF A FLUID CONDUIT

(71) Applicant: BLACKHAWK SPECIALTY TOOLS, LLC, Houston, TX (US)

(72) Inventors: Ron D. Robichaux, The Woodlands, TX (US); James G. Martens, Houston, TX (US); John E. Hebert, Houma, LA (US); Juan Carlos E. Mondelli, Houston, TX (US); James Champagne, Houma, LA (US); Joseph Boudreaux, Houma, LA (US); Scottie J. Scott, Houma, LA (US); Jeremy LeCompte, Houma, LA (US)

(73) Assignee: Blackhawk Specialty Tools, LLC, Houston, TX (US)

( * ) Notice: Subject to any disclaimer, the term of this patent is extended or adjusted under 35 U.S.C. 154(b) by 0 days.

(21) Appl. No.: 15/013,156

(22) Filed: Feb. 2, 2016

(65) Prior Publication Data

US 2016/0145953 A1 May 26, 2016

Related U.S. Application Data

(63) Continuation of application No. 14/566,694, filed on Dec. 10, 2014.

(60) Provisional application No. 61/914,476, filed on Dec. 11, 2013.

(51) Int. Cl.

| | |
|---|---|
| ***E21B 19/00*** | (2006.01) |
| ***E21B 33/038*** | (2006.01) |
| ***E21B 33/05*** | (2006.01) |
| ***E21B 21/02*** | (2006.01) |
| ***E21B 19/22*** | (2006.01) |

(52) U.S. Cl.

CPC ..... *E21B 19/008* (2013.01); *E21B 19/22* (2013.01); *E21B 21/02* (2013.01); *E21B 33/038* (2013.01); *E21B 33/05* (2013.01)

(58) Field of Classification Search

CPC ..... E21B 19/008; E21B 19/22; E21B 21/02; E21B 33/038; E21B 33/05

See application file for complete search history.

(56) References Cited

U.S. PATENT DOCUMENTS

| | | | | |
|---|---|---|---|---|
| 4,615,646 | A * | 10/1986 | Langner | E21B 43/0107 166/347 |
| 4,877,356 | A * | 10/1989 | Bontenbal | E21B 43/013 166/341 |
| 2004/0238342 | A1* | 12/2004 | Oder | C10B 25/10 202/242 |
| 2009/0295150 | A1* | 12/2009 | Dupont | B63B 27/24 285/237 |

(Continued)

*Primary Examiner* — Robert E Fuller
*Assistant Examiner* — Christopher Sebesta
(74) *Attorney, Agent, or Firm* — Ted M. Anthony

(57) ABSTRACT

A connection assembly for automated lifting and positioning of a chiksan or other fluid conduit in proximity to a fluid inlet of a device such as, for example, a cement head. Once a chiksan or other flow line is positioned in a desired location, a secure connection is made between the outlet of the chiksan or other fluid conduit and the fluid inlet of a cement head including, without limitation, when the cement head is positioned at an elevated location above a rig floor.

6 Claims, 19 Drawing Sheets

(56) References Cited

U.S. PATENT DOCUMENTS

| | | | | |
|---|---|---|---|---|
| 2010/0294479 | A1* | 11/2010 | Shee | E21B 19/008 166/65.1 |
| 2011/0146993 | A1* | 6/2011 | Sahni | E21B 43/20 166/305.1 |
| 2011/0229270 | A1* | 9/2011 | Rios | E21B 17/015 405/169 |
| 2012/0133122 | A1* | 5/2012 | Hovik | B63B 27/24 285/27 |
| 2013/0284457 | A1* | 10/2013 | Laurel | E21B 17/05 166/380 |

* cited by examiner

METHOD AND APPARATUS FOR AUTOMATED CONNECTION OF A FLUID CONDUIT

BACKGROUND OF THE INVENTION

1. Field of the Invention

The present invention pertains to an automated assembly for connecting a fluid flow line to an inlet port. More particularly, the present invention pertains to an automated assembly for connecting a fluid flow line (such as a chiksan, hose or other conduit) to an inlet port of a cement head assembly.

2. Brief Description of the Related Art

Many offshore oil and/or gas wells are drilled in marine environments using floating vessels (such as, for example, drill ships and semi-submersible drilling rigs), particularly prior to installation of a permanent platform or other similar structure. Drilling operations conducted from such floating vessels differ from those conducted from permanent structures in many respects.

One important difference associated with drilling from a floating vessel is the location of blowout preventer and wellhead assemblies. When drilling from a fixed platform or other similar structure, a blowout preventer assembly is typically located on a rig, platform or other structure. However, when drilling from a floating drilling vessel, blowout preventer and wellhead assemblies are not located on the drilling rig, platform or other structure; rather, such assemblies are located at or near the sea floor. As a result, specialized equipment known as "subsea" blowout preventer and wellhead assemblies typically must be utilized.

During cementing operations, an apparatus known as a cement head is typically installed above a rig's work surface or "rig floor" in order to provide a connection or interface between a rig's lifting system and surface pumping equipment, on the one hand, and down hole work string and/or other tubular goods extending into a well, on the other hand. Such cement heads must permit cement slurry to flow from a pumping assembly into a well, and should have sufficient flow capacity to permit high pressure pumping of large volumes of cement and other fluids at high flow rates. Such cement heads must also have sufficient tensile strength to support heavy weight tubular goods and other equipment extending from the rig into a well, and to accommodate raising and lowering of such tubular goods and equipment.

Although such cement heads are typically utilized in connection with wells drilled in offshore or marine environments, it is to be observed that such cement heads can also be used in connection with the drilling/equipping of onshore wells using land-based drilling rigs. Furthermore, such cement heads are frequently (although not necessarily exclusively) utilized on onshore and offshore drilling rigs equipped with top drive drilling systems. In certain circumstances, said cement heads are used on rigs equipped with a kelly and rotary table, instead of a top drive unit.

In many cases, such cement heads must be positioned high above a rig floor during cementing operations. In such situations, a fluid conduit must extend from a rig's pumping system (which is typically located at or near the rig floor level) to said elevated cement head. On drilling rigs equipped with a top drive system, it is possible to pump cement and/or other fluids from a rig's pumping system through said top drive unit and a top drive hose extending to a cement head. However, such a configuration is not preferred for cementing operations, because an unexpected loss of power or pumping shut down could result in cement slurry hardening within the top drive unit, top drive hoses and/or ancillary equipment.

As a result, a rig's top drive system is frequently bypassed for this purpose and a temporary fluid conduit is typically utilized to connect a surface cement pumping system to the inlet port of a cement head. Such temporary fluid conduit, which can be relatively heavy, can comprise a high pressure hose, a swiveled flow-link apparatus commonly referred to as a "chiksan", or other flow line(s). Because a cement head may be located at an elevated location above a rig floor, the distal end or outlet of said fluid conduit typically must also be lifted to an elevated location in order to position it in close proximity to said cement head. Further, such fluid conduit must be securely coupled or connected to a fluid inlet port on said elevated cement head in order to permit pressurized fluid (including, without limitation, heavy cement slurry) to flow through said cement head.

In many instances, a cement head will typically be positioned at an elevated position out of reach of personnel working on a rig floor, thereby making it difficult for such personnel to easily access the cement head in order to connect chiksans, flow lines and/or other fluid conduits to said cement head. Moreover, such personnel often must be hoisted off the rig floor using a makeshift seat or harness attached to a winch or other lifting device in order to reach the cement head for this purpose. When this occurs, such personnel are at risk of falling and suffering serious injury or death. Moreover, such personnel are frequently required to carry heavy hammers, wrenches and/or other tools used to facilitate connection of the flow conduit to the cement head inlet, thereby increasing the risk of such items being accidentally dropped on personnel and/or equipment positioned on the rig floor below.

Thus, there is a need for a method and apparatus for automated lifting/positioning of a chiksan or other fluid conduit in proximity to a lifting top drive cement head, as well as secure connection of said chiksan or other fluid conduit to a lifting top drive cement head including, without limitation, when said lifting top drive cement head is positioned at an elevated location above a rig floor.

SUMMARY OF THE INVENTION

The automated connection assembly of the present invention generally comprises a hoist or lifting assembly mounted at or near a cement head that can attach to the distal end or outlet of a high pressure hose or chiksan line. Said lifting assembly can be used to selectively draw or otherwise motivate said outlet conduit end toward a fluid inlet having an attachment device (such as, for example, a quick-lock receptacle) attached to or in fluid communication with a cement head. Once said outlet conduit end has been beneficially moved to a desired position, said outlet conduit can be securely received by and attached to said receptacle to facilitate flow of pressurized fluids through said conduit and into said cement head.

Although the specific configuration of the present invention can vary, in a preferred embodiment the automatic connection assembly of the present invention comprises a winch assembly that can be mounted above or otherwise in proximity to a cement head. A cable extends from said winch assembly to a distal end (outlet) of a chiksan or other temporary fluid conduit; said cable can be beneficially looped around at least one alignment pulley attached to said distal end of said chiksan/fluid conduit, with the distal end of said cable being anchored or secured near said winch assembly.

By retracting said winch assembly, said cable acts to lift and draw said distal end of said chiksan/fluid conduit toward a quick lock receptacle which is in fluid communication with an inlet port of said cement head. Said quick lock receptacle can comprise a downwardly facing and substantially conical or tapered entry guide to direct said distal end of said chiksan/fluid conduit to an inlet port of said quick lock receptacle.

After the distal end of said chiksan/fluid conduit is received by said quick lock receptacle, said quick lock receptacle can be remotely actuated in order to securely connect said chiksan/fluid conduit in place and form a fluid pressure seal to permit pumping of pressurized fluid (such as, for example, cement slurry) through said chiksan/fluid conduit and into said cement head. Following pumping operations, said quick lock receptacle can be remotely actuated to disconnect said chiksan/fluid conduit. Thereafter, said winch assembly can be actuated to extend said cable and lower said distal end of said chiksan/fluid conduit (such as to personnel situated on a rig floor) for further handling.

In an alternative embodiment, an articulating arm assembly is disposed on a cement head (or on nearby casing, a top drive unit or other convenient location) rather than being attached to a drilling rig derrick. As a cement head is raised within a derrick, a signal can be sent to a remote control panel to notify personnel (such as, for example, a driller) the said head is positioned at a predetermined location. A chiksan or other fluid conduit can be raised in proximity to said cement head using a winch line or other hoisting or lifting mechanism. A guide may be used to minimize movement of the chiksan/fluid conduit.

Once the distal end of the chiksan or fluid conduit reaches an appropriate position (which may be optionally signaled by light, buzzer or other remote feedback system), said articulating arm can extend, grasp or latch the distal end of the chiksan or fluid conduit, and securely connect said distal end to the inlet port of the cement head. The process can be remotely controlled from an operator console, or beneficially controlled using an automated recognition, grasp, align and attachment operating system. Disconnection of said chiksan/fluid conduit from said cement head can also be remotely actuated.

In a preferred embodiment, the automated connection assembly of the present invention can further comprise at least one safety pressure switch that senses the existence of an elevated fluid pressure across said connection, as well as controller that prevents disconnection in the event of such pressure. Additionally, cable roller guides can protect winch cables as they pass through various openings during operation of the present invention. Gear guards and other protective shields can also be employed.

An alternative embodiment of the automated connection assembly of the present invention comprises an articulating arm assembly, such as an arm assembly that can be permanently attached to a drilling rig derrick. When not in use, said arm can be retracted and stored relatively flush with the derrick and out of the way of well operations. As a cement head is raised within a derrick, a signal can be sent to a remote control panel to notify personnel (such as, for example, a driller) the said head is positioned at a predetermined location. Said arm can then be extended using pneumatics, hydraulics, a pushing chain or any other acceptable movement mechanism to attach a cement fluid conduit to and inlet port of said cement head. Thereafter, said flow line can be detached from said arm in order to allow said cement head to reciprocate. After pumping through said fluid conduit is completed, said fluid conduit can be remotely disconnected and retracted away from said cement head.

Other alternative embodiments are contemplated and addressed in detail herein.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
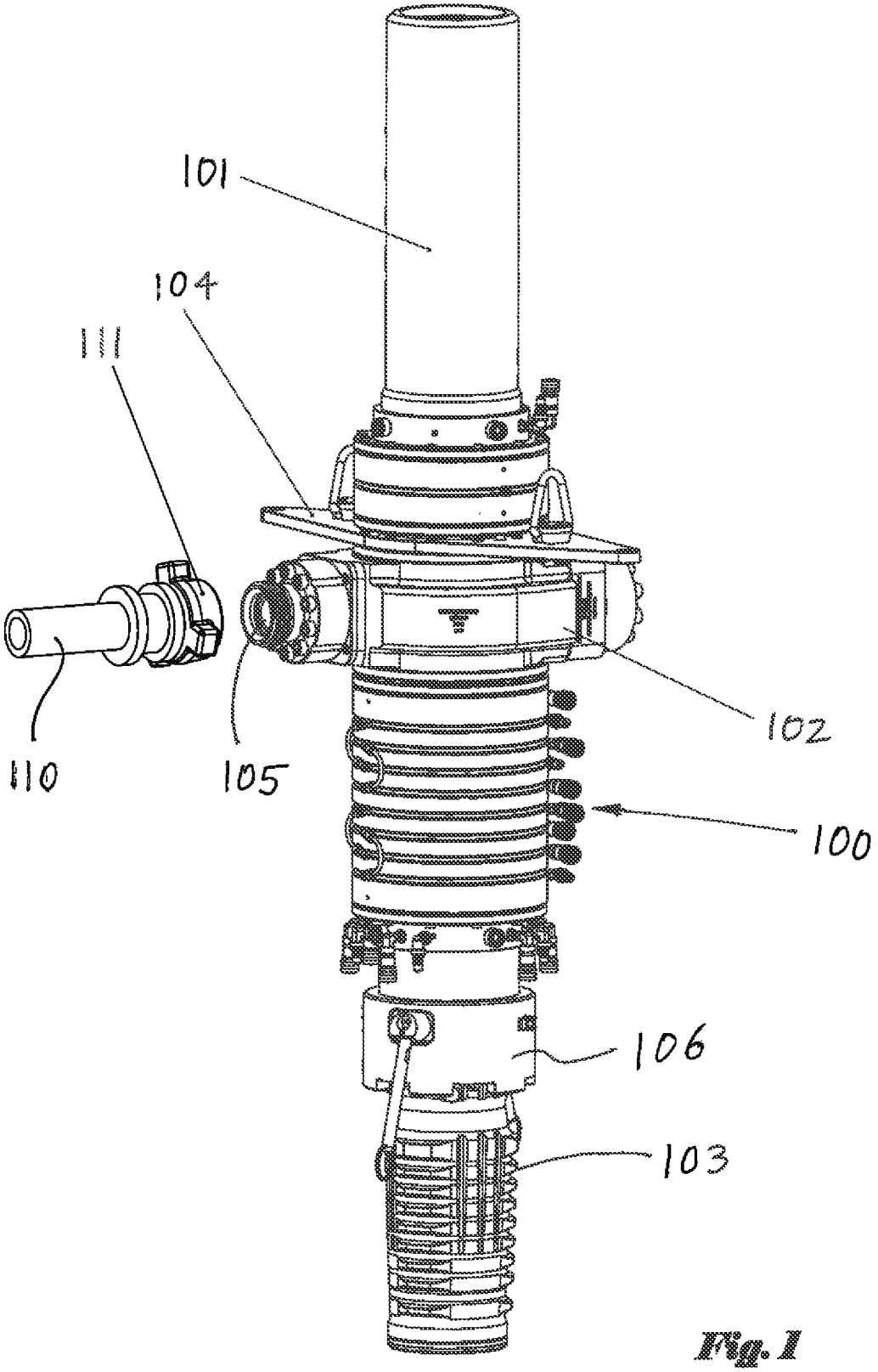
FIG. 1 depicts a side perspective view of a conventional top-drive cement head equipped with a hammer union connection to facilitate connection of a fluid conduit to a primary fluid inlet port of said cement head.

Referring to the drawings, FIG. 1 depicts a side perspective view of an upper portion of a conventional top-drive cement head assembly 100. Said cement head assembly 100 generally comprises upper body member 101 which can be attached to a lower connection of a rig's top drive unit or other equipment (not pictured), as well as lower connection member 103 having lower connection hub 106 which can be attached to other cementing components or equipment, such as other cement head assembly components well known to those having skill in the art.

Cement head assembly 100 further comprises swivel assembly 102 having a fluid inlet 105 well known to those having skill in the art, as well as torque plate 104. Said torque plate 104 can be chained or otherwise secured to a rig component or other stationary object to permit rotation of cement head assembly 100, while securing non-rotating components of said cement head assembly 100. It is to be observed that cement head assembly 100 as depicted herein typically includes other components attached below connection hub 106; however, those components are not depicted herein for simplicity, but would normally be included as part of a typical cement head configuration.

As noted above, fluid conduit 110 is typically utilized to connect a surface cement pumping system to inlet port 105 of cement head assembly 100. Such temporary fluid conduit 110, which can comprise a high-pressure hose, a swiveled flow-link chiksan or other flow line(s), is equipped with connector 111 for connecting said fluid conduit 110 to cement head assembly 100. As depicted in FIG. 1, said connector 111 comprises a WECO 1502-type hammer union; however, it is to be observed that said connector 111 can be one of any number of well-known temporary connectors.

During operation, cement head assembly 100 is frequently positioned at an elevated position out of reach of personnel working on the rig floor, thereby making it difficult for such personnel to easily access cement head assembly 100 in order to connect fluid conduit 110 to said cement head assembly 100, and to disconnect said fluid conduit from said cement head assembly 100. Moreover, the distal end or outlet of said fluid conduit 110 typically must also be lifted to an elevated location in order to position it in close proximity to said cement head assembly 100. Fluid conduit 110 must be securely coupled or connected to fluid inlet port 105 of said elevated cement head assembly 100 using connector 111 in order to permit pressurized fluid (including, without limitation, heavy cement slurry) to flow through said fluid conduit 110 and into said cement head assembly 100 via fluid inlet 105.

In conventional rig configurations, fluid conduit 110 is raised using a rig's hoisting system from a rig floor to an elevated cement head. In most instances, a cable of the hoisting system is attached to the distal end of fluid conduit 110 near connector 111. Such cable is frequently attached at a sufficient distance from said distal end so that fluid conduit 100 is permitted to swivel, while providing sufficient clearance for a person (who is also lifted using a make-shift harness or lifting belt attached to a hoist) to grab and manipulate said fluid conduit 110 in order to attach connector 111 to inlet 105 of said cement head assembly 100. After connecting said fluid conduit 110 to said inlet 105, a rig's hoisting cable is connected to cement head 100 (typically via torque plate 104) using a snatch block and is then anchored at the rig floor to permit reciprocation.

Figure 2:
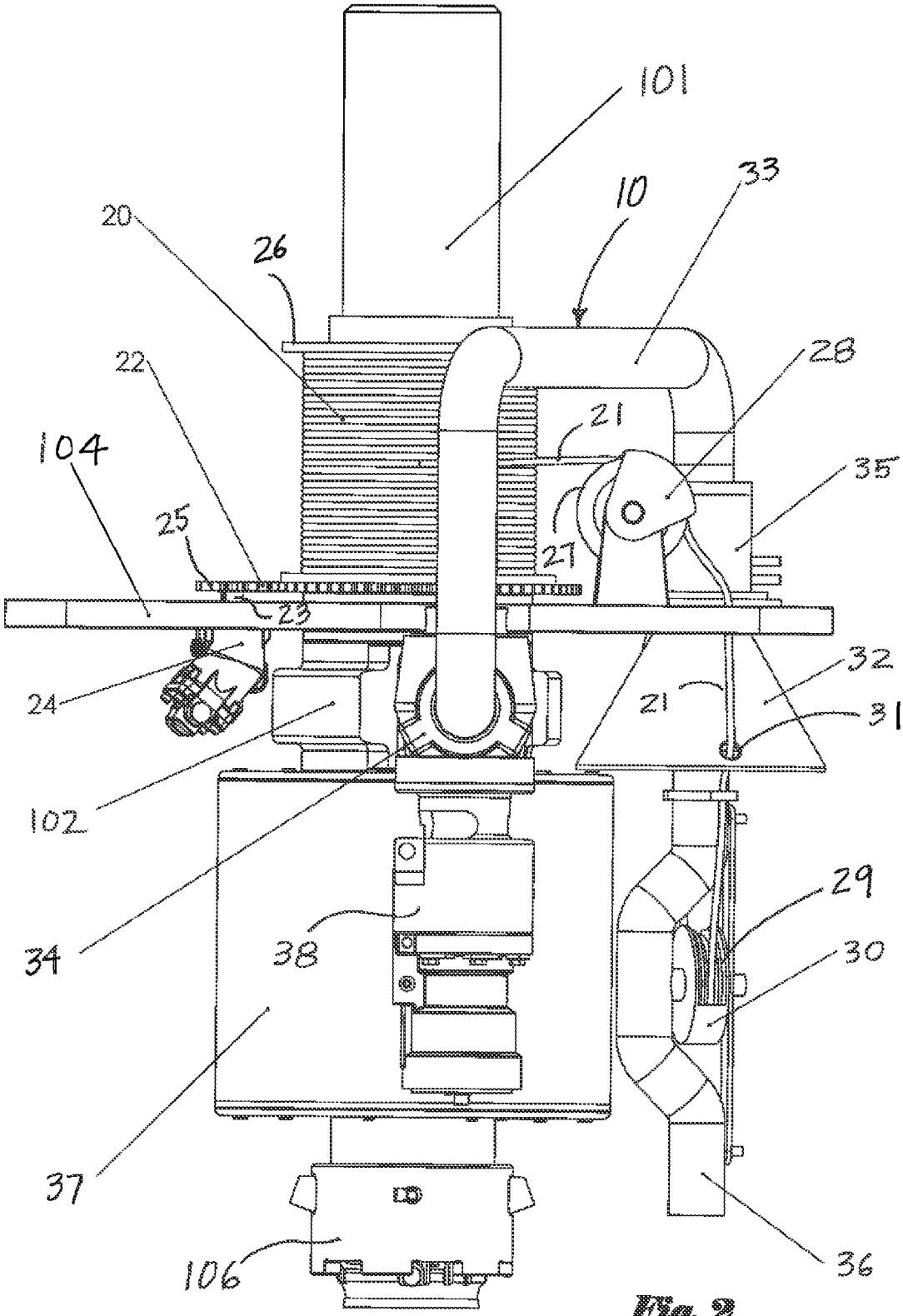
FIG. 2 depicts a side view of a preferred embodiment of the automated connection assembly of the present invention comprising a winch and cable system to facilitate movement and connection of a fluid conduit to a primary fluid inlet port of said cement head.

FIG. 2 depicts a side view of a preferred embodiment of the automated connection assembly 10 of the present invention. As discussed in detail herein, said automated connection assembly 10 generally comprises a winch and cable system to facilitate movement and connection of a fluid conduit to a cement head assembly. Said cement head assembly generally comprises many of the same functional components as cement head assembly 100 depicted in FIG. 1 such as, for example, upper body member 101 which can be attached to a lower connection of a rig's top drive unit or other equipment, lower connection hub 106 (attached to a lower connection member, not shown), fluid swivel assembly 102 having a fluid inlet 105 and torque plate 104.

Automated connection assembly 10 comprises winch assembly 20 having cable 21 partially spooled on winch drum 26, as well as winch drive spur gear 22. Winch drive motor 24 has drive shaft 23 connected to drive gear 25, which engages with drive spur gear 22. In a preferred embodiment, said drive motor 24 is hydraulically powered; however, it is to be observed that said motor 24 can be beneficially powered using another power source such as, by way of illustration, pneumatic or electrical power.

A portion of cable 21 that is unspooled from winch drum 26 passes over block pulley 27 having pulley guard 28, passes through an aperture in torque plate 104, passes through an aperture 31 extending through connector guide funnel 32 and loops around lower pulley 29 having lower pulley guard 30. Although not visible in FIG. 2, the distal end of said cable 21 is anchored to torque plate 104.

A connector pipe 33 is attached to plug valve 38 using connector union 34. Plug valve 38, in turn, is connected inlet 105 (not visible in FIG. 2) of fluid swivel assembly 102. Connector pipe 33 extends to quick-lock connection receiver 35. Adapter extension 36 attaches to the outlet at the distal end of a fluid conduit supplying fluid to said cement head (such as, for example, fluid conduit 110 depicted in FIG. 1). Housing 37 provides an enclosure for housing electronics, communications components and/or power supply equipment utilized in connection with the powering and operation of automated connection assembly 10.

Figure 3:
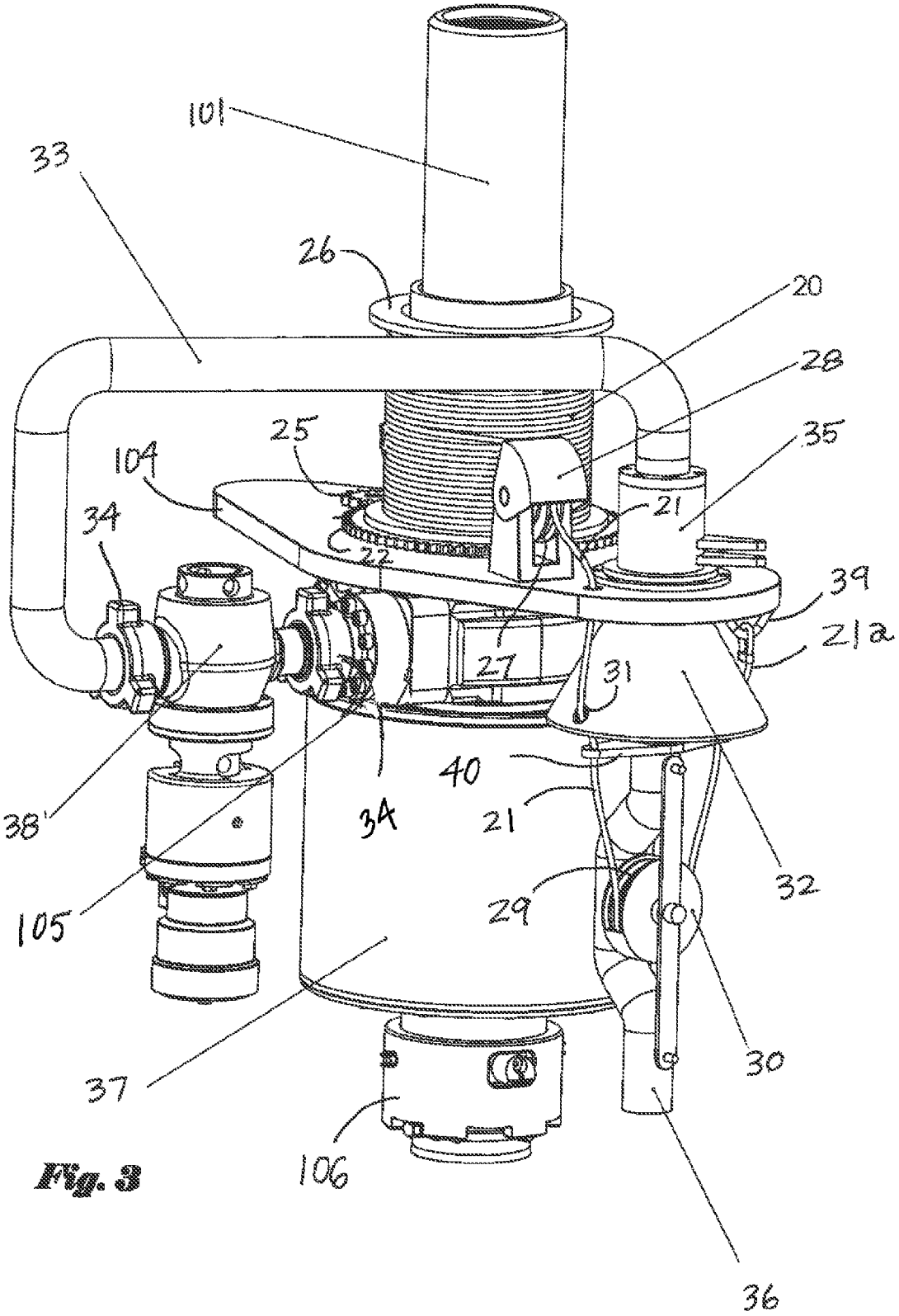
FIG. 3 depicts a perspective view of a preferred embodiment of the automated connection assembly of the present invention comprising a winch and cable system to facilitate movement and connection of a fluid conduit to a primary fluid inlet port of said cement head.

FIG. 3 depicts a perspective view of a preferred embodiment of the automated connection assembly 10 of the present invention generally comprising winch assembly 20 having cable 21 partially spooled on winch drum 26, as well as winch drive spur gear 22. Winch drive motor 24, attached to torque plate 104, drives drive gear 25 which engages with spur gear 22 to turn winch drum 26 about a rotational axis that is oriented substantially parallel to the longitudinal axis of upper body member 101. A portion of cable 21 is unspooled from winch drum 26, passes over block pulley 27 having pulley guard 28, runs through an aperture in torque plate 104, runs through aperture 31 of connector guide funnel 32 and bridle member 40, loops around lower pulley 29 having lower pulley guard 30, and passes back through bridle member 40. Distal end 21*a* of cable 21 is anchored to torque plate 104 using mounting bracket 39.

Connector pipe 33 has a first end and a second end. Said first end is connected to plug valve 38 using union 34, while plug valve 38 is connected to cement head fluid swivel inlet 105. Said second end of connector pipe 33 is attached to and is in fluid communication with quick-lock connection receiver 35. Adapter extension 36 attaches to the outlet of a fluid conduit supplying fluid to said cement head (such as fluid conduit 110 depicted in FIG. 1).

Figure 3A:
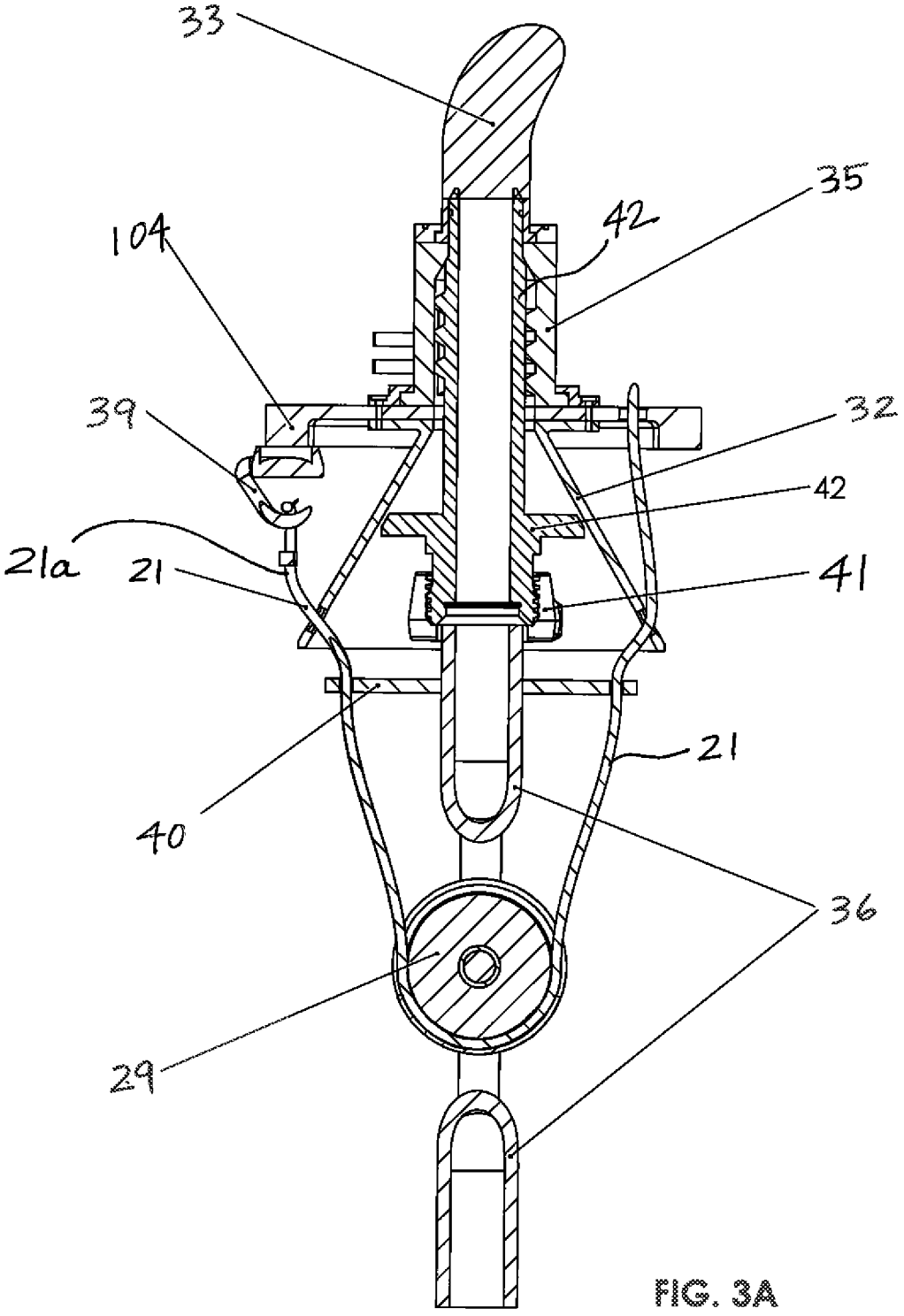
FIG. 3A depicts a side sectional view of a preferred embodiment of the automated connection assembly of the present invention comprising a winch and cable system to facilitate movement and connection of a fluid conduit to a cement head.

FIG. 3A depicts a side sectional view of a portion of an automated connection assembly 10 of the present invention. A portion of cable 21 is unspooled from winch drum 26 (not shown in FIG. 3A), and extends through an aperture in torque plate 104 and aperture 31 of connector guide funnel 32. Said cable 21 continues through one side of bridle member 40, and loops around lower pulley 29 having lower pulley guard 30. Said cable 21 continues through an opposite side of bridle member 40, while distal end 21*a* of cable 21 is anchored to torque plate 104 using mounting bracket 39.

Connector pipe 33 is attached to, and is in fluid communication with, quick-lock connection receiver 35. Quick-lock male connection member 42—which forms a "stinger"—is connected to the upper end of adapter extension 36 using union 41. Although not depicted in FIG. 3A, it is to be observed that the lower end of adapter extension 36 can be connected to, and is in fluid communication with, the outlet of a hose, chiksan or other fluid conduit used for pumping fluid (including, without limitation, cement slurry) to a cement head such as, for example, fluid conduit 110 depicted in FIG. 1.

Referring generally to FIGS. 3 and 3A, during operation a desired length of cable 21 can be unwound from winch drum 26 of winch assembly 20. When quick-lock male connection member 42 is disengaged from quick-lock receiver 35, such unspooled cable passes through lower pulley 29. Because distal end 21*a* of cable 21 is anchored to torque plate 104, said cable 21 essentially forms a selectively expandable loop. Continued unspooling of cable 21 from winch drum 26, causes said loop to expand, which in turn permits bridle member 40, lower pulley 29, adapter extension 36 and quick-lock male connection member 42 to be lowered as a combined assembly from an elevated cement head to a rig floor or other convenient staging area below. Once positioned at the rig floor or other convenient location, lower end of said adapter extension 36 can be attached to the outlet of a fluid conduit used for pumping cement slurry and/or other fluid to an elevated cement head (such as, for example, a chiksan line or fluid conduit 110 depicted in FIG. 1).

Figure 4:
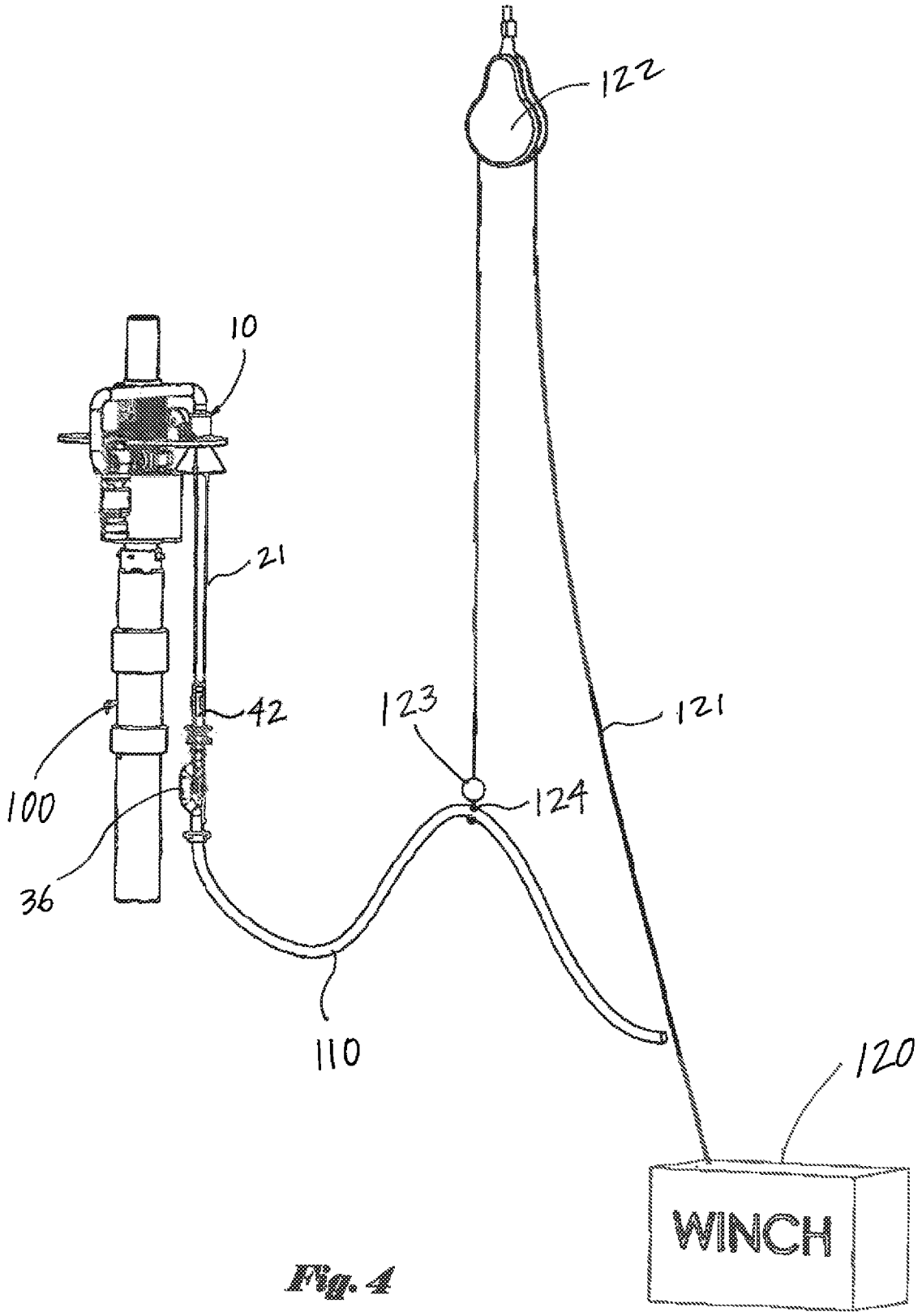
FIG. 4 depicts a side view of a preferred embodiment automated connection assembly assisted by the use of a hoisting device.

FIG. 4 depicts a side view of a preferred embodiment automated connection assembly 10 (with adapter extension 36 attached to the outlet of a fluid conduit 110 used for pumping cement slurry and/or other fluid to an elevated cement head) assisted by the use of a hoisting device, such as winch 120 having cable 121. It is to be observed that winch 120 can comprise a rig's hoisting system, or other hoisting system utilized for this purpose. Cable 121 is looped through pulley or sheave 122, and is connected to fluid conduit 110 at a desired location using a shackle 124 or other gripping device. The distal end of said cable 121 can also include a weighted block member 123.

Referring back to FIGS. 3 and 3A, as cable 21 is rewound or taken up onto winch drum 26 of winch assembly 20, bridle member 40, lower pulley 29, adapter extension 36 and quick-lock male connection member 42 are raised from a rig floor or other convenient staging area to the elevated cement head. As depicted in FIG. 4, because said adapter extension 36 is connected to fluid conduit 110, the outlet of said fluid conduit is also lifted toward said elevated cement head 100 (and, more specifically, connector guide funnel 32). Winch 120 and cable 121 can be used to provide added lifting capacity and support for fluid conduit 110 as said conduit is lifted toward cement head assembly 100.

Figure 5:
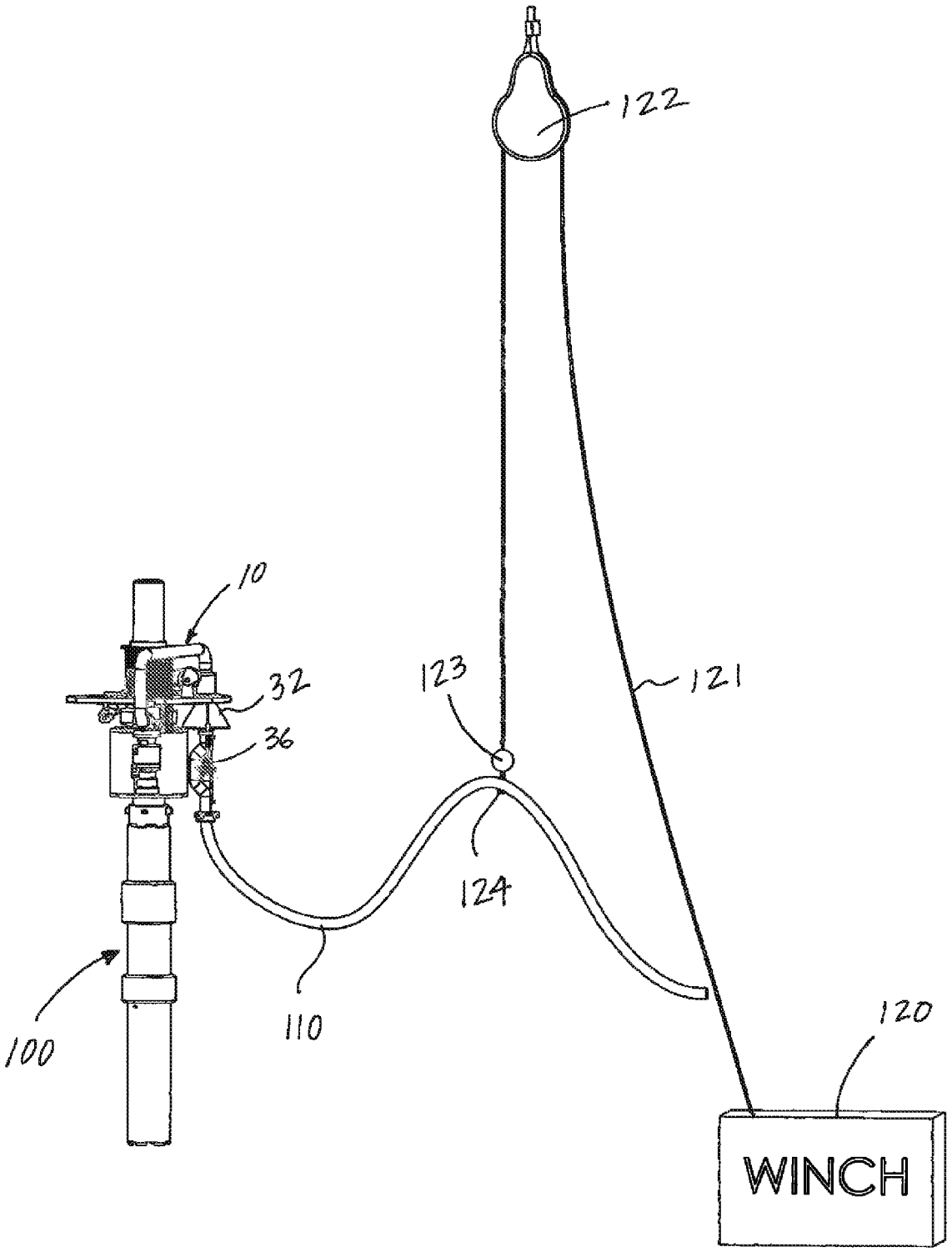
FIG. 5 depicts a side view of a preferred embodiment automated connection assembly assisted by the use of a hoisting device.

FIG. 5 depicts a side view of a preferred embodiment automated connection assembly assisted by the use of a winch 120 further in the connection sequence and from a different perspective as the view in FIG. 4. Eventually, quick-lock male connection member 42 is received within quick-lock receiver 35, and can be connected in a fluid-tight connection via remote operation. Winch 120 may be used to provide additional capacity to lift and support said fluid conduit 110, particularly during rig up and rig down operations, pumping operations and/or when said fluid conduit 110 comprises an assembly of relatively heavy metal chiksans.

Referring back to FIGS. 3 and 3A, as stinger-like quick-lock male connection member 42 is lifted toward said elevated cement head, bridle member 40 and lower pulley 29 ensure proper alignment and orientation of said quick-lock male connection member 42 and attached adapter extension 36. Continued winding of cable 21 on winch drum 26 of winch assembly 20 causes quick-lock male connection member 42 to enter connector guide funnel 32 which, in turn, acts as a stabbing guide and directs quick-lock male connection member 42 to be received within female quick-lock receiver 35. With said male connection member 42 stung in, quick-lock receiver 35 can be selectively actuated, thereby engaging against and forming a fluid pressure seal with quick-lock male connection member 42. Said bridle member 40 can also include a built-in snatch to allow for reciprocation.

When release of said fluid conduit is desired (such as, for example, following cement pumping operations), the connection process can be generally repeated in reverse order. Quick-lock receiver 35 can be disengaged, thereby releasing male connection member 42 from gripping engagement with said quick-lock receiver 35. A desired length of cable 21 can be unspooled from winch drum 26, which permits bridle member 40, lower pulley 29, quick-lock male connection member 42, as well as adapter extension 36 (connected to the outlet of a fluid conduit) to be lowered from an elevated cement head to a rig floor or other convenient staging area below. Such lowering process is aided by gravity, while winch 120 can provide added support during such lowering process. With said fluid conduit 110 lowered to desired location (such as a rig floor or other convenient staging area), said fluid conduit 110 can be safely and conveniently disconnected from adapter extension 36 as part of the rig-down process.

Figure 6:
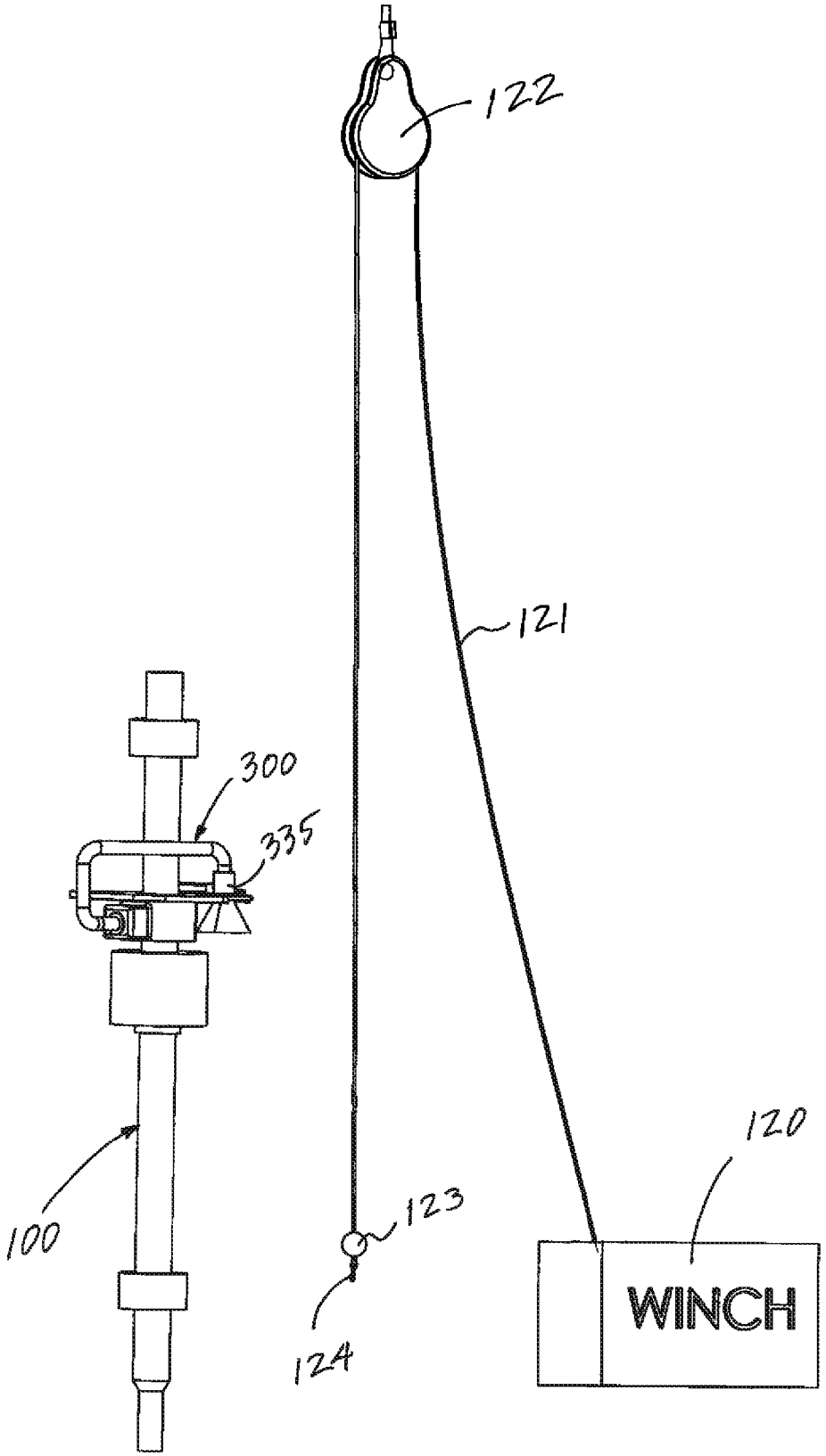
FIG. 6 depicts a side view of an alternative embodiment automated connection assembly assisted by the use of a hoisting device.

FIG. 6 depicts a side view of an alternative embodiment automated connection assembly 300 assisted by the use of a hoisting device 120. As noted above, winch 120 can comprise a rig's existing hoisting system, or other hoisting system utilized for this purpose. Cable 121 is looped through pulley or sheave 122, and is connected to fluid conduit 110 at a desired location using a shackle 124 or other gripping device. The distal end of said cable 121 can also include a weighted block member 123.

Figure 7:
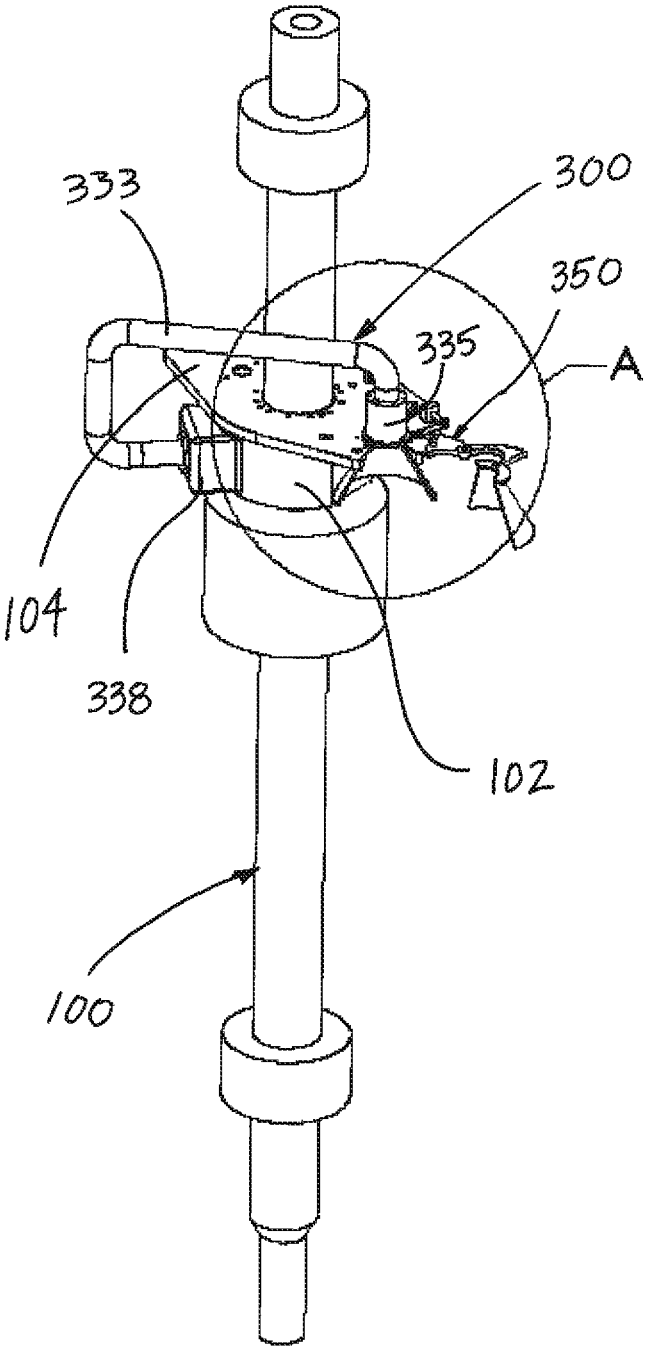
FIG. 7 depicts a side perspective view of an alternative embodiment automated connection assembly depicted in FIG. 6.
Figure 7A:
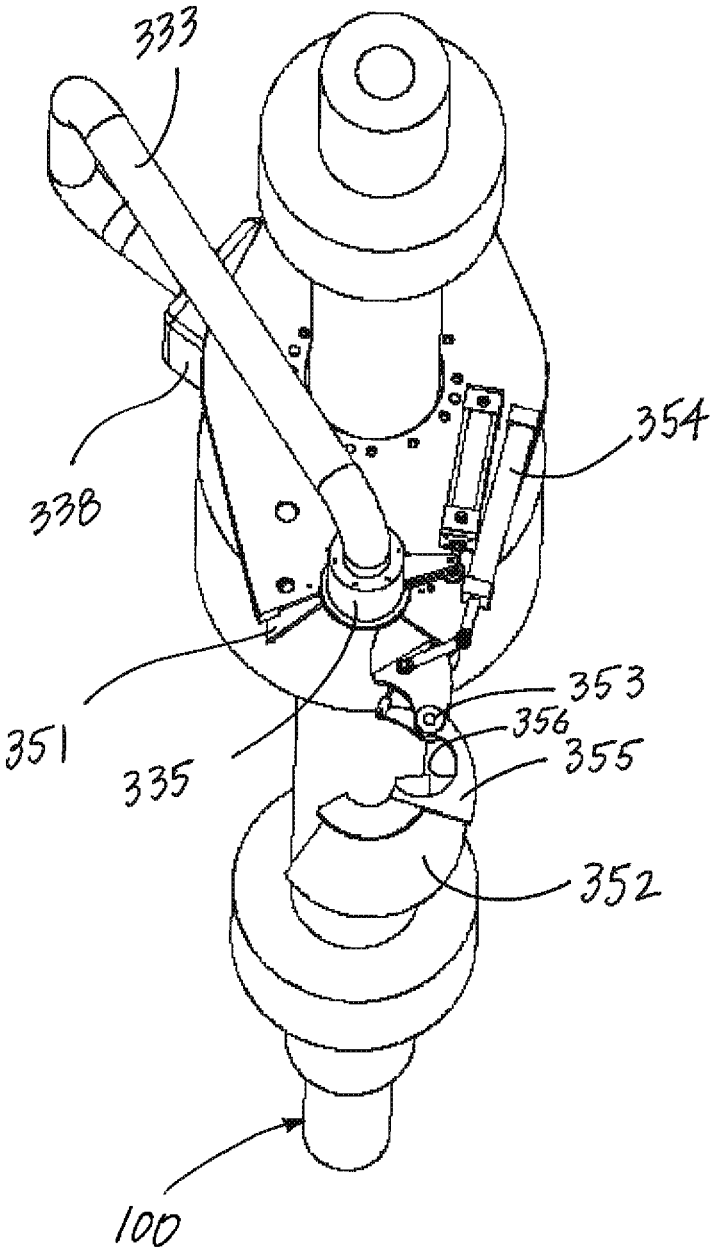
FIG. 7A depicts a detailed view of the highlighted area depicted in FIG. 7.

FIG. 7 depicts a side perspective view of an alternative embodiment automated connection assembly 300 depicted in FIG. 6, while FIG. 7A depicts a detailed view of the highlighted area depicted in FIG. 7. A connector pipe 333 of automated connection assembly 300 has a first end and a second end. Said first end is attached to plug valve 338 which, in turn, is connected to a fluid inlet (not visible in FIG. 7) of cement head fluid swivel assembly 102. Said second end of connector pipe 333 extends to quick-lock connection receiver 335.

A hinged connector guide funnel assembly is disposed at or near the bottom of said quick-lock connection receiver 335. Referring to FIG. 7A, said hinged connector guide funnel assembly includes stationary funnel portion 351. Movable funnel portion 352 is hingedly attached to said stationary funnel portion 351 using pivot hinge pin 353. Opening and closing of said movable funnel portion 352 can be powered by actuation cylinder 354 which can be remotely operated. Cable guide 355 defining eyelet opening 356 is also provided in general proximity to said connector guide funnel assembly.

Figure 8:
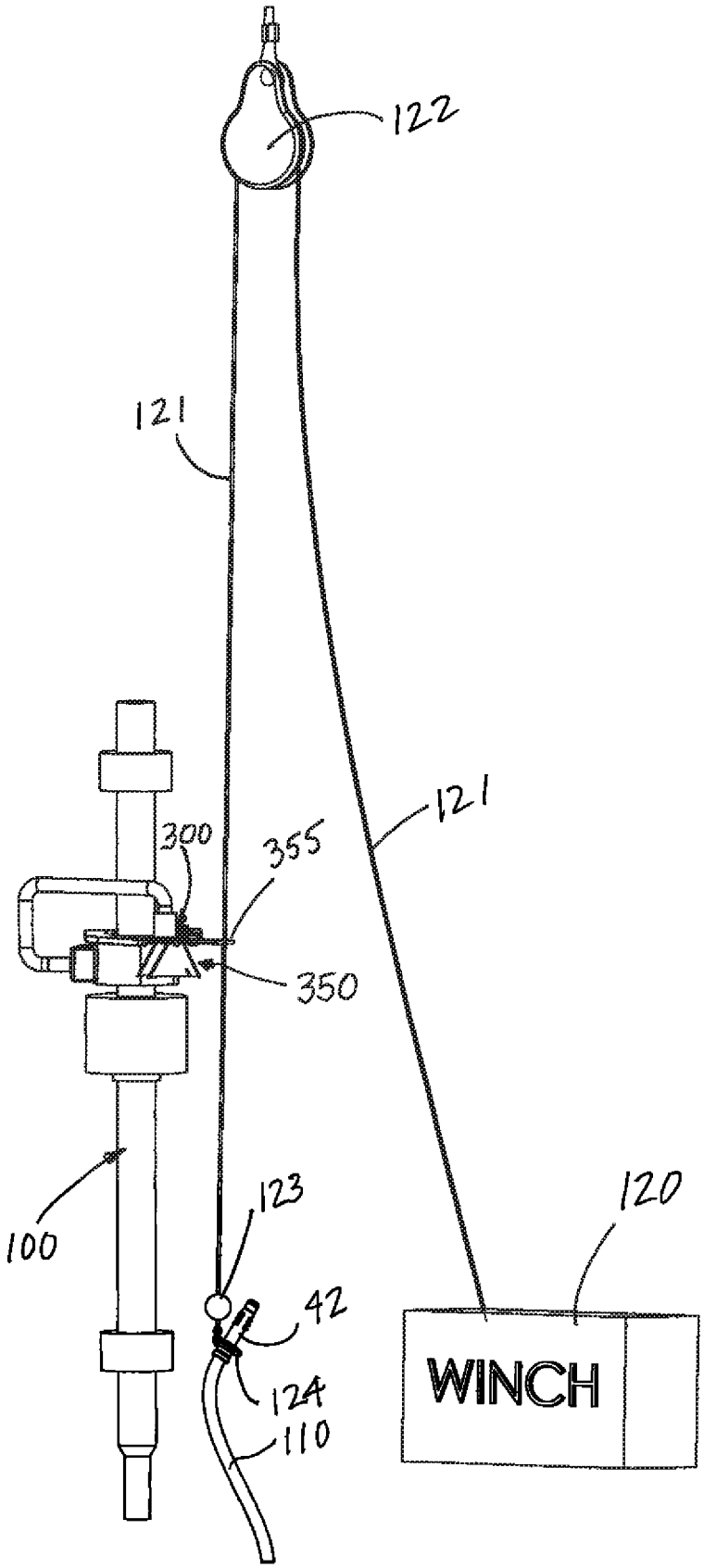
FIG. 8 depicts a side view of an alternative embodiment automated connection assembly assisted by the use of a hoisting device.
Figure 9:
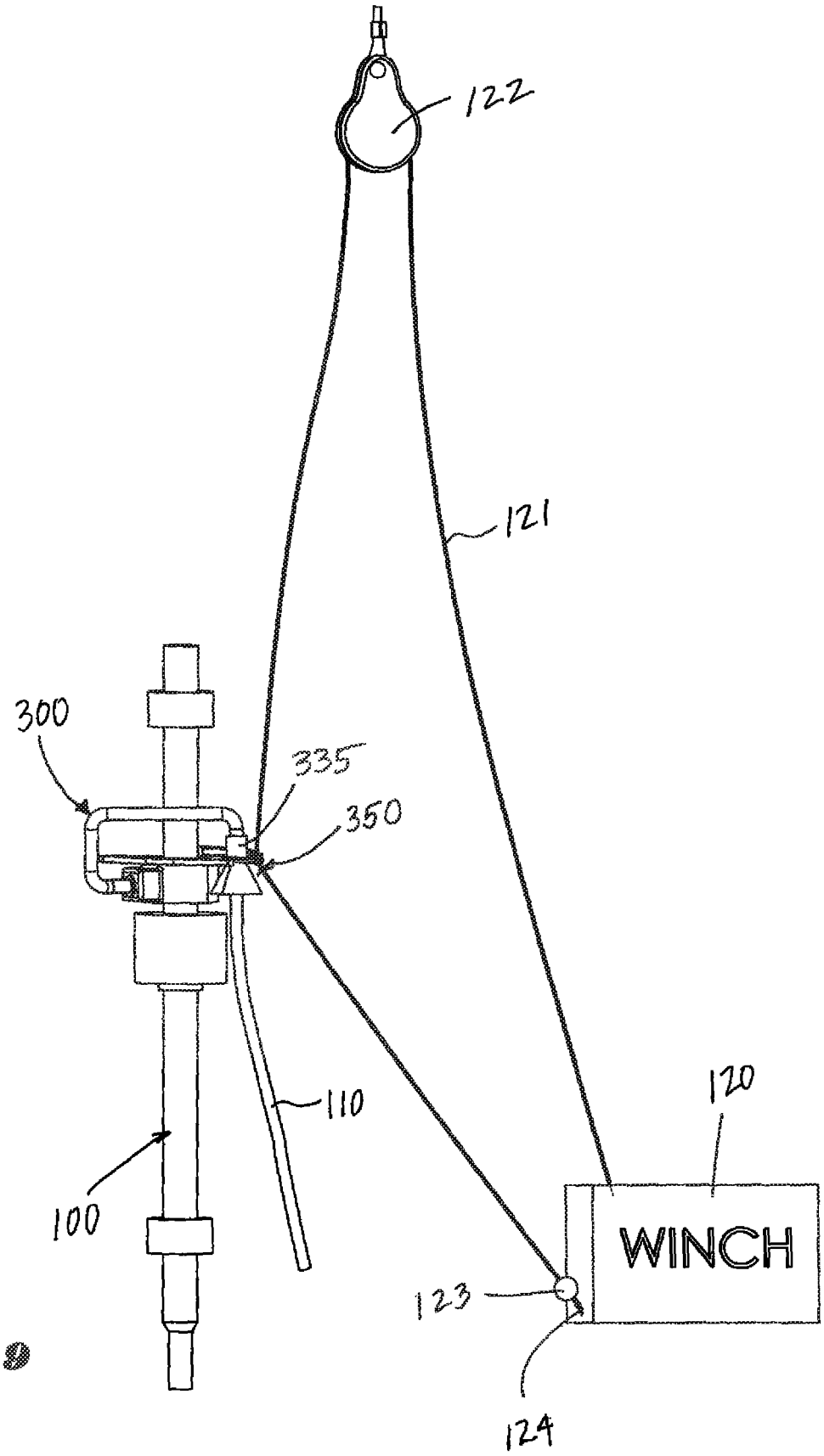
FIG. 9 depicts a side view of an alternative embodiment automated connection assembly assisted by the use of a hoisting device.

FIGS. 8 and 9 depict side views of alternative embodiment automated connection assembly 300 assisted by the use of winch 120 at different stages of the attachment process. Referring to FIG. 8, quick-connect male stinger attachment 42 attaches to the outlet of a fluid conduit 110 used for supplying fluid (such as, for example, cement slurry) to said cement head 100. Cable 121 extends from winch 120, is looped through pulley or sheave 122, passes through an eyelet guide formed by hinged connector guide assembly 350, and is connected to fluid conduit 110 at a desired location using a shackle 124 or other gripping device. The distal end of said cable 121 can also include a weighted block member 123.

As cable 121 is rewound or taken up onto winch 120, quick-lock male connection member 42 is raised from a rig floor or other convenient staging area to elevated cement head 100. As depicted in FIG. 9, because said quick-lock male connection member 42 is connected to the outlet of fluid conduit 110, the outlet of said fluid conduit 110 is also lifted toward said elevated cement head 100 (and, more specifically, hinged connector guide funnel assembly 350). Cable 121 is maintained in proper alignment using cable guide 355. Eventually, quick-lock male connection member 42 is received within quick-lock receiver 335, and can be connected in a fluid-tight connection via remote operation.

Winch 120 may be used to lift and support said fluid conduit 110, particularly during rig up and rig down operations, pumping operations and/or when said fluid conduit 110 comprises an assembly of relatively heavy metal chiksans. As depicted in FIG. 9, after said quick-lock male connection member 42 is received within quick-lock receiver 335 and connected in a fluid-tight connection via remote operation, shackle 124 can be released from fluid conduit 100 and dropped to a rig floor, winch 120 or other anchoring point.

Figure 10:
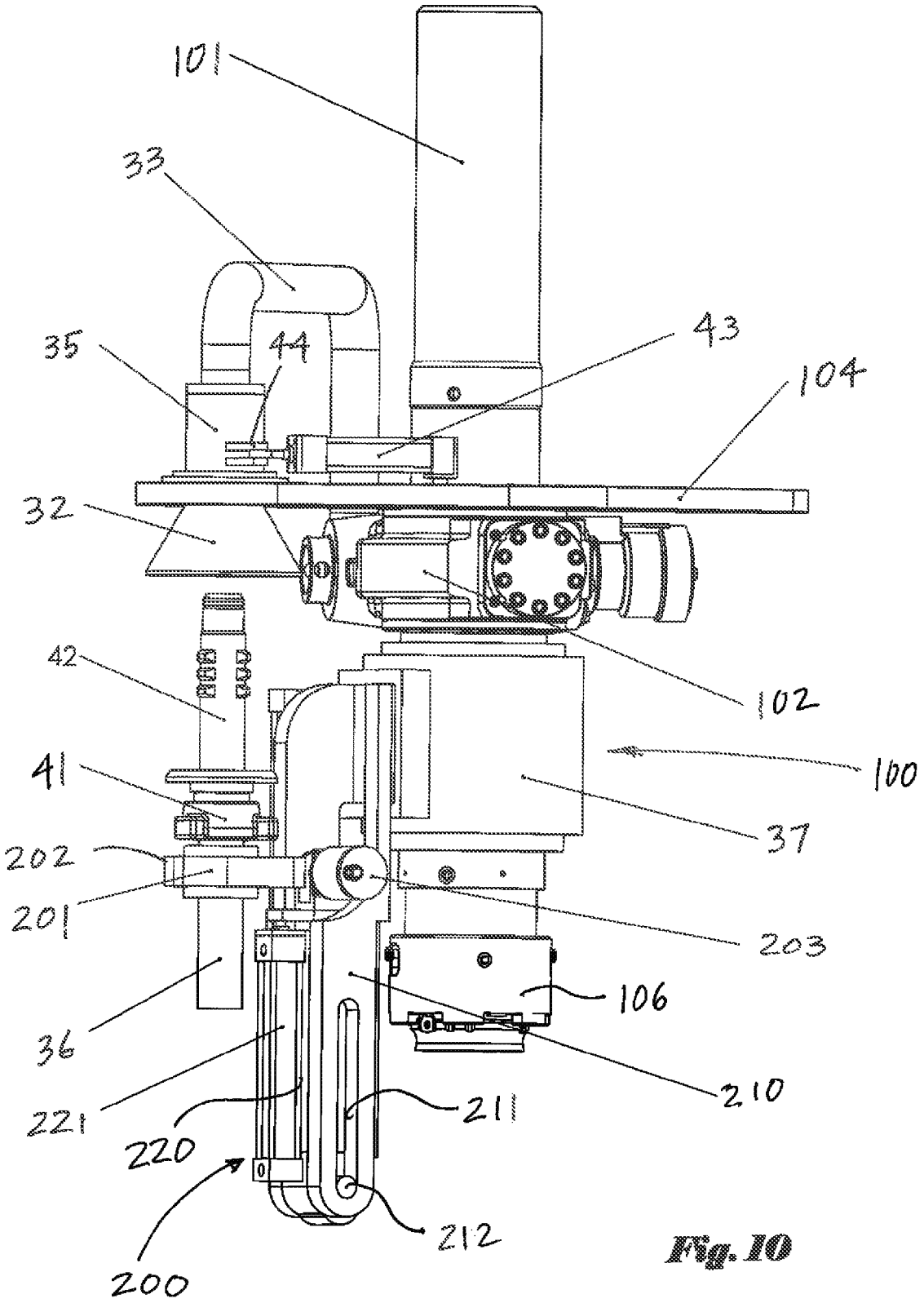
FIG. 10 depicts a side view of a second alternative embodiment of the automated connection assembly of the present invention comprising an articulating arm assembly, which is depicted in a substantially retracted position.

FIG. 10 depicts a side view of an alternative embodiment of the automated connection assembly of the present invention comprising articulating arm assembly 200. Cement head assembly 100 generally comprises many of the same functional components previously described herein such as, for example, upper body member 101 which can be attached to a lower connection of a rig's top drive unit or other equipment, lower connection hub 106 (which is typically attached to a lower connection member and other conventional cement head components), fluid swivel assembly 102, torque plate 104 and housing 37.

Connector pipe 33 is attached to, and is in fluid communication with, quick-lock connection receiver 35. Quick-lock male connection member 42—which forms a "stinger"—is connected to the distal end of adapter extension 36 using union 41. Although not depicted in FIG. 10, it is to be observed that the lower or proximate end of adapter extension 36 can be connected to, and is in fluid communication with, the outlet of a hose, chiksan or other fluid conduit used for pumping fluid (including, without limitation, cement slurry) to a cement head (such as, for example, fluid conduit 110 depicted in FIG. 1).

Quick lock actuation cylinder 43 is affixed to torque plate 104 and is pivotally connected to quick lock clevis bracket 44 on quick-lock receiver 35. Actuation of quick lock cylinder 43 causes rotation of quick-lock receiver 35. Thus, when quick-lock connection member 42 is received within said quick-lock receiver 35, selective rotation of said quick-lock receiver 35 through actuation of quick lock cylinder 43 permits remote control of connection and disconnection of said quick-lock connection member 42 in said quick-lock receiver 35. It is to be observed that said quick-lock connection and disconnection means can also be employed with automated connection assembly 10 discussed above.

Alternatively, said quick-lock receiver 35 can comprise opposing sealing rams or elements that can be selectively closed against the outer surface of quick-lock male connection member 42. Said opposing sealing rams each travel in a linear path, and can be selectively opened or closed without requiring rotation (as shown with quick-lock receiver 35).

Articulating arm assembly 200 generally comprises opposing grabbing jaw members 201 and 202. In a preferred embodiment, said grabbing jaws 201 and 202 comprise arcuate inner surfaces that generally conform in size and configuration to the external surface of adapter extension 36. Said opposing grabbing jaws can be actuated—that is, selectively spread apart and closed together—using actuation motor 203. Said articulating arm assembly 200 further comprises hanging arm member 210 having elongate slot 211. A lower arm 220 is pivotally attached to said hanging arm member 210 using pivot pin 212. Lower arm cylinder 221 is attached to said lower arm 220.

Figure 11:
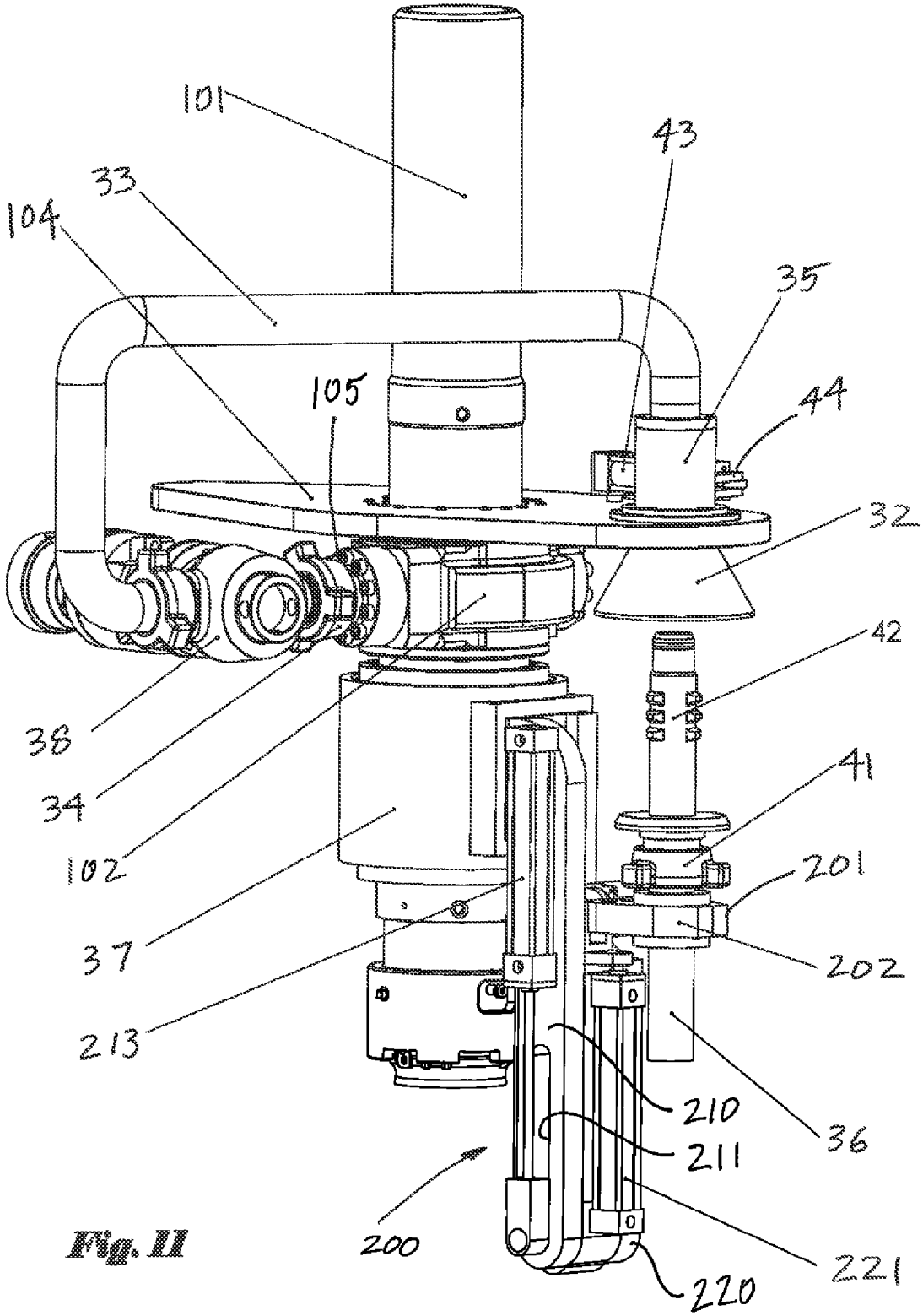
FIG. 11 depicts a side perspective view of said second alternative embodiment of the automated connection assembly of the present invention comprising an articulating arm assembly, which is depicted in a substantially retracted position.

FIG. 11 depicts a side perspective view of said alternative embodiment of the automated connection assembly of the present invention comprising an articulating arm assembly 200, rotated approximately 90 degrees from the view depicted in FIG. 10. Connector pipe 33 is attached to, and is in fluid communication with, quick-lock connection receiver 35 at one end. At opposite end, connector pipe 33 is attached to plug valve 38 which, in turn, is connected to fluid inlet 105 of said cement head using union 34.

Quick-lock male connection member 42—which forms a "stinger"—is connected to the distal end of adapter extension 36 using union 41. Although not depicted in FIG. 11, it is to be observed that the lower or proximate end of adapter extension 36 can be connected to, and is in fluid communication with, the outlet of a fluid conduit used for pumping fluid to a cement head.

Quick lock cylinder 43 is affixed to torque plate 104 and is pivotally connected to quick lock clevis bracket 44 on quick-lock receiver 35. Actuation of quick lock cylinder 43 causes rotation of quick-lock receiver 35. Thus, when quick-lock connection member 42 is received within said quick-lock receiver 35, actuation of quick lock cylinder 43 permits remote connection and disconnection of said quick-lock connection member 42 in said quick-lock receiver 35.

Articulating arm assembly 200 generally comprises opposing grabbing jaw members 201 and 202. In a preferred embodiment, said grabbing jaws 201 and 202 comprise arcuate inner surfaces that generally conform in size and configuration to the external surface of adapter extension 36. Said opposing grabbing jaws can be actuated using actuation motor 203. Said articulating arm assembly 200 further comprises hanging arm member 210 having elongate slot 211. A lower arm 220 is pivotally attached to said hanging arm member 210. Lower arm cylinder 221 is attached to said lower arm 220, while hanging arm cylinder 213 is attached to hanging arm 210.

Figure 12:
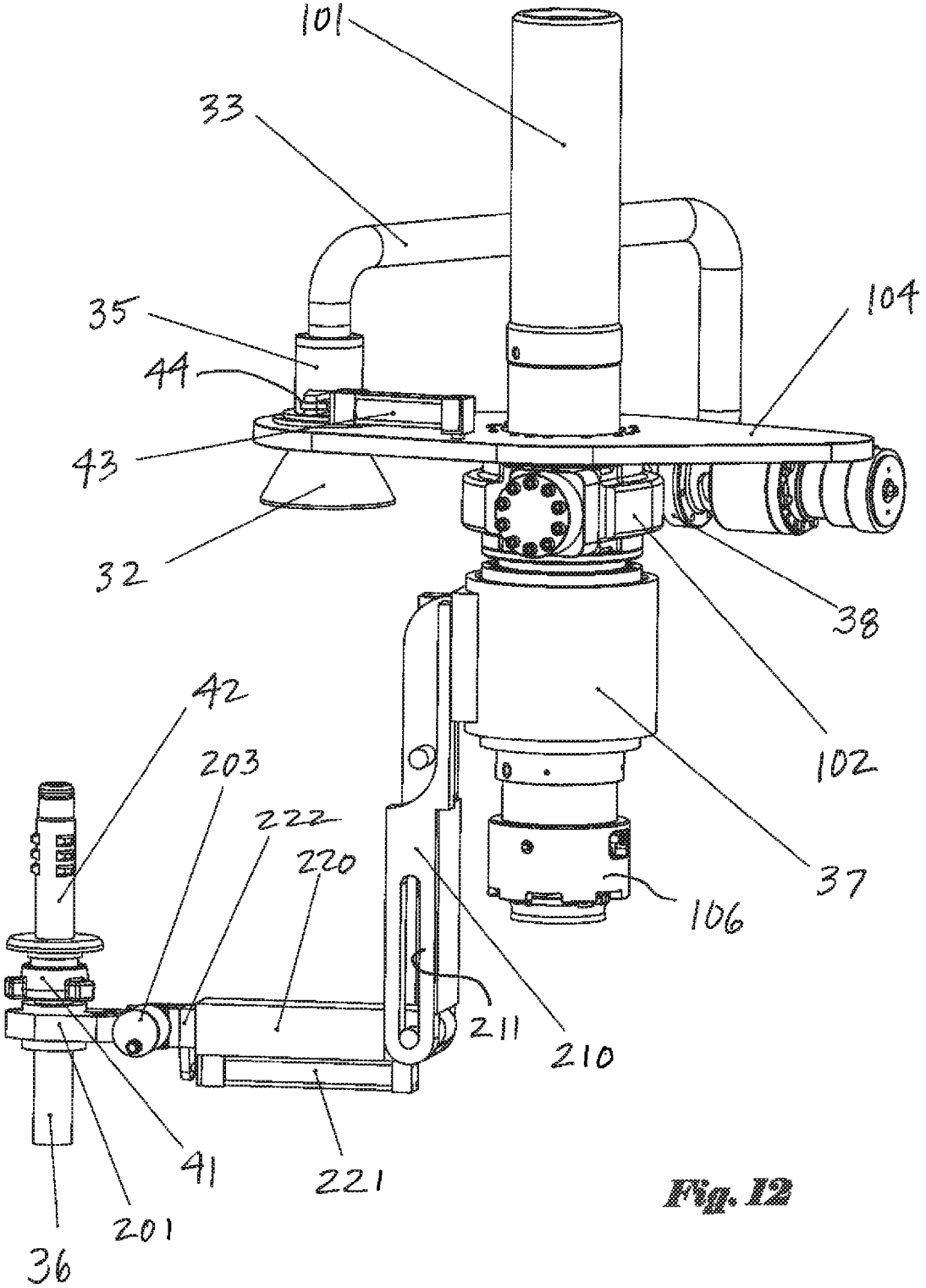
FIG. 12 depicts a side perspective view of said second alternative embodiment of the automated connection assembly of the present invention comprising an articulating arm assembly in a partially extended configuration.

FIG. 12 depicts a side perspective view of said alternative embodiment of the automated connection assembly of the present invention comprising an articulating arm assembly 200 in a partially extended configuration. Connector pipe 33 has a first end and second end. Said first end is attached to, and is in fluid communication with, quick-lock connection receiver 35, while said second end is attached to plug valve 38 which, in turn, is connected to fluid inlet 105 of said cement head using union 34.

Quick-lock male connection member 42—which forms a "stinger" extension—is connected to the distal end of adapter extension 36 using union 41. Although not depicted in FIG. 6, it is to be observed that the lower or proximate end of adapter extension 36 can be connected to, and is in fluid communication with, the outlet of a fluid conduit used for pumping fluid to a cement head. Quick lock cylinder 43 is affixed to torque plate 104 and is pivotally connected to quick lock clevis bracket 44 on quick-lock receiver 35. When quick-lock connection member 42 is received within said quick-lock receiver 35, actuation of quick lock cylinder 43 permits remote connection and disconnection of said quick-lock connection member 42 in said quick-lock receiver 35.

Articulating arm assembly 200 generally comprises opposing grabbing jaw members 201 and 202. In a preferred embodiment, said grabbing jaws 201 and 202 comprise arcuate inner surfaces that generally conform in size and configuration to the external surface of adapter extension 36. Said opposing grabbing jaws can be actuated to spread apart, or close together, using actuation motor 203.

Said articulating arm assembly 200 further comprises hanging arm member 210 having elongate slot 211. A lower arm 220, having lower arm extension 222, is pivotally attached to said hanging arm member 210. Lower arm cylinder 221 is attached to said lower arm 220, while hanging arm cylinder 213 is attached to hanging arm 210.

During operation, quick-lock male connector 42 (attached to the distal end of a fluid conduit, such as chiksan line 110 in FIG. 1) is raised to a desired height, typically in relatively close proximity a cement head inlet port. Articulating arm assembly 200, operated through a remote control system, can be extended to grab adapter extension 36 attached to the distal end of said fluid conduit; specifically, grabber jaws 201 and 202 are spread apart, positioned near said adapter extension 36, and then closed in order to grip against the outer surface of said adapter extension 36. Thereafter, with said adapter extension 36 gripped, said arm assembly 200 can guide and stab said quick-lock male connector 42 into connector guide funnel 32. A fluid pressure seal can be formed between quick-lock male connector 42 and quick-lock receiver 35. After a connection is made, a winch cable that is used to raise said fluid conduit can be lowered and anchored at or near the rig floor.

Figure 13:
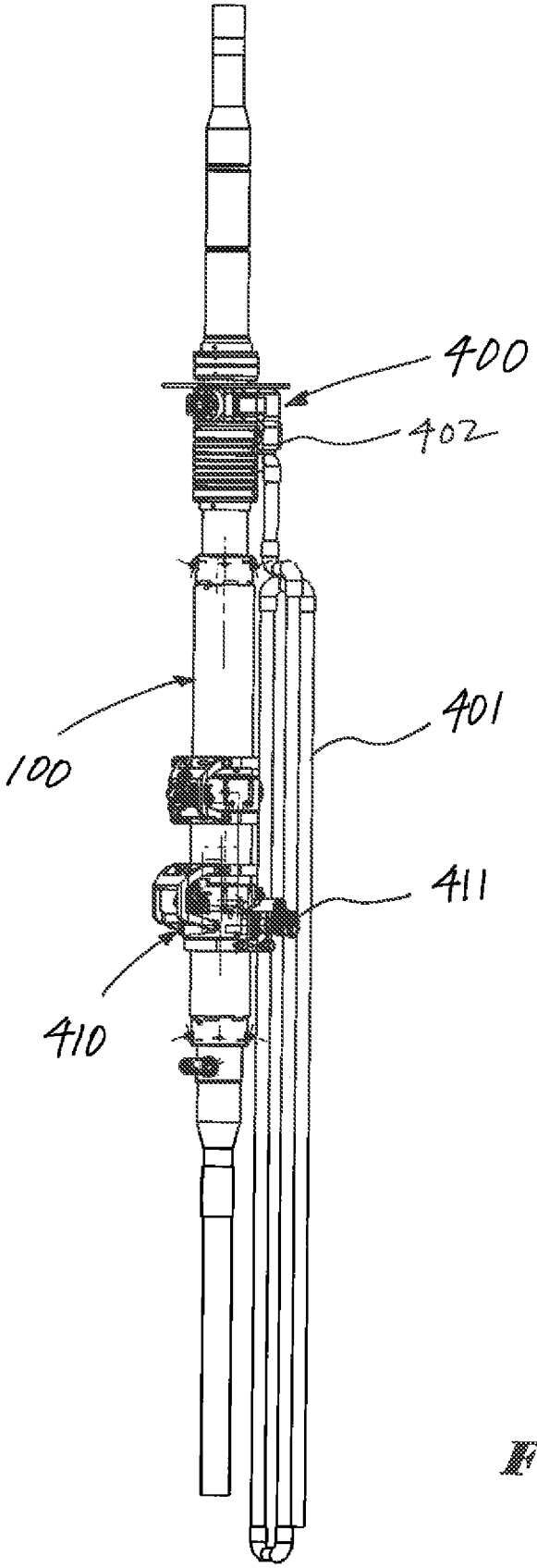
FIG. 13 depicts a side view of a third alternative embodiment of the automated connection assembly of the present invention in a substantially stowed configuration.

FIG. 13 depicts a side view of a third alternative embodiment of the automated connection assembly 400 of the present invention in a substantially stowed configuration. Chiksan extension member 401, depicted in a partially folded configuration, is connected to a fluid swivel inlet (not visible in FIG. 13) of cement head assembly 100. Gripping assembly 410 is connected at or near cement head assembly 100, and comprises gripping apparatus 411. Said gripping assembly 410 can be remotely operated, and can selectively grip and release chiksan extension member 401. In the configuration depicted in FIG. 13, cement head assembly 100 equipped with chiksan extension member 401, can be lifted to an elevated position within a drilling rig derrick.

Figure 14:
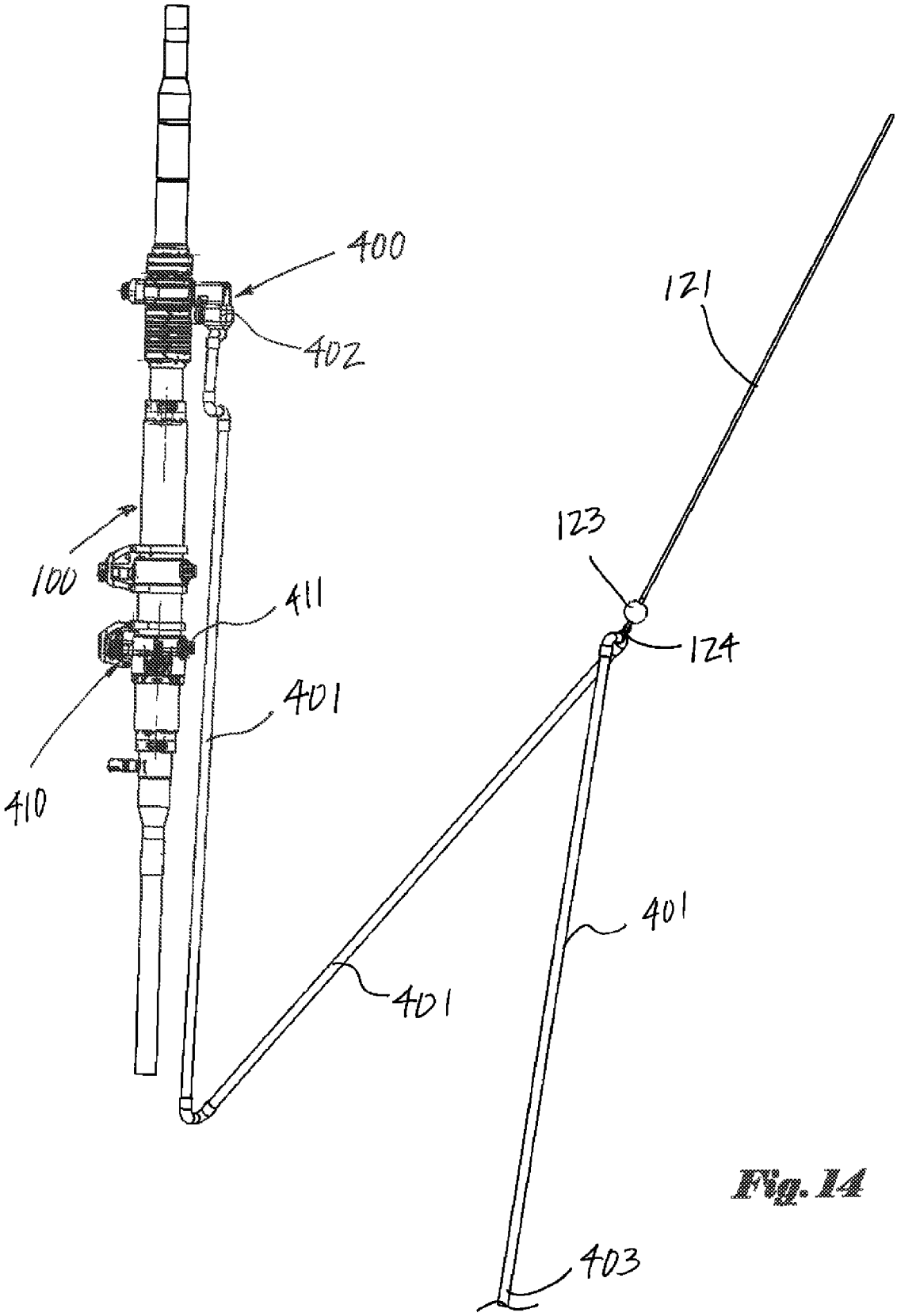
FIG. 14 depicts a side perspective view of said third alternative embodiment of the automated connection assembly of the present invention in a partially deployed configuration.

FIG. 14 depicts a side perspective view of said third alternative embodiment of the automated connection assembly 400 of the present invention in a partially deployed configuration. After said cement head 100 has been properly positioned at an elevated location, gripping apparatus 411 can be selectively opened to release a grip on chiksan extension member 401. In this configuration, cable 121 from a winch or other hoisting device can be attached to chiksan extension member 401, and used to selectively position lower end 403 of said chiksan extension member 401 to a desired position (such as a rig floor or other staging area).

Figure 15:
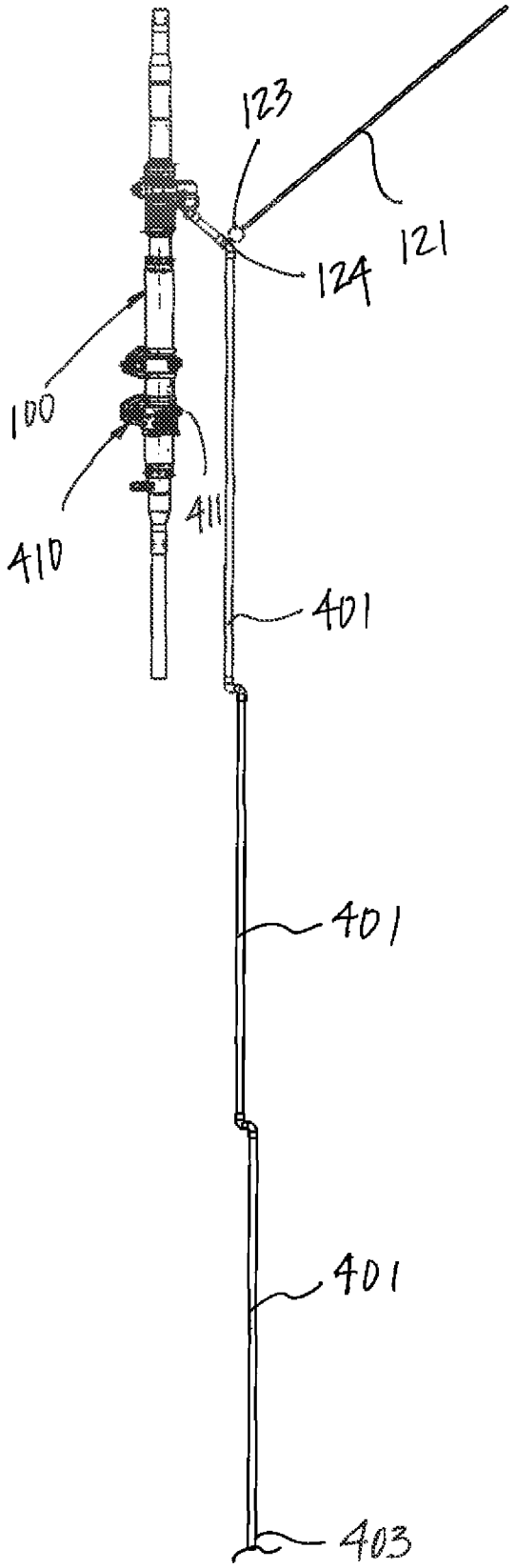
FIG. 15 depicts a side perspective view of said third alternative embodiment of the automated connection assembly of the present invention in a substantially deployed configuration.

FIG. 15 depicts a side perspective view of said third alternative embodiment of the automated connection assembly 400 of the present invention in a substantially deployed configuration with lower end 403 of chiksan extension member 401 positioned at or near a rig floor or other staging area. With said lower end 403 so positioned, another chiksan or fluid conduit can be conveniently and safely attached to said lower end 403 at or near said rig floor or other staging area; as a result, a substantially continuous fluid conduit can be connected to the inlet port of cement head 100 without requiring lifting of personnel or connection of pipe unions at elevated location(s) in proximity to said cement head.

Figure 16:
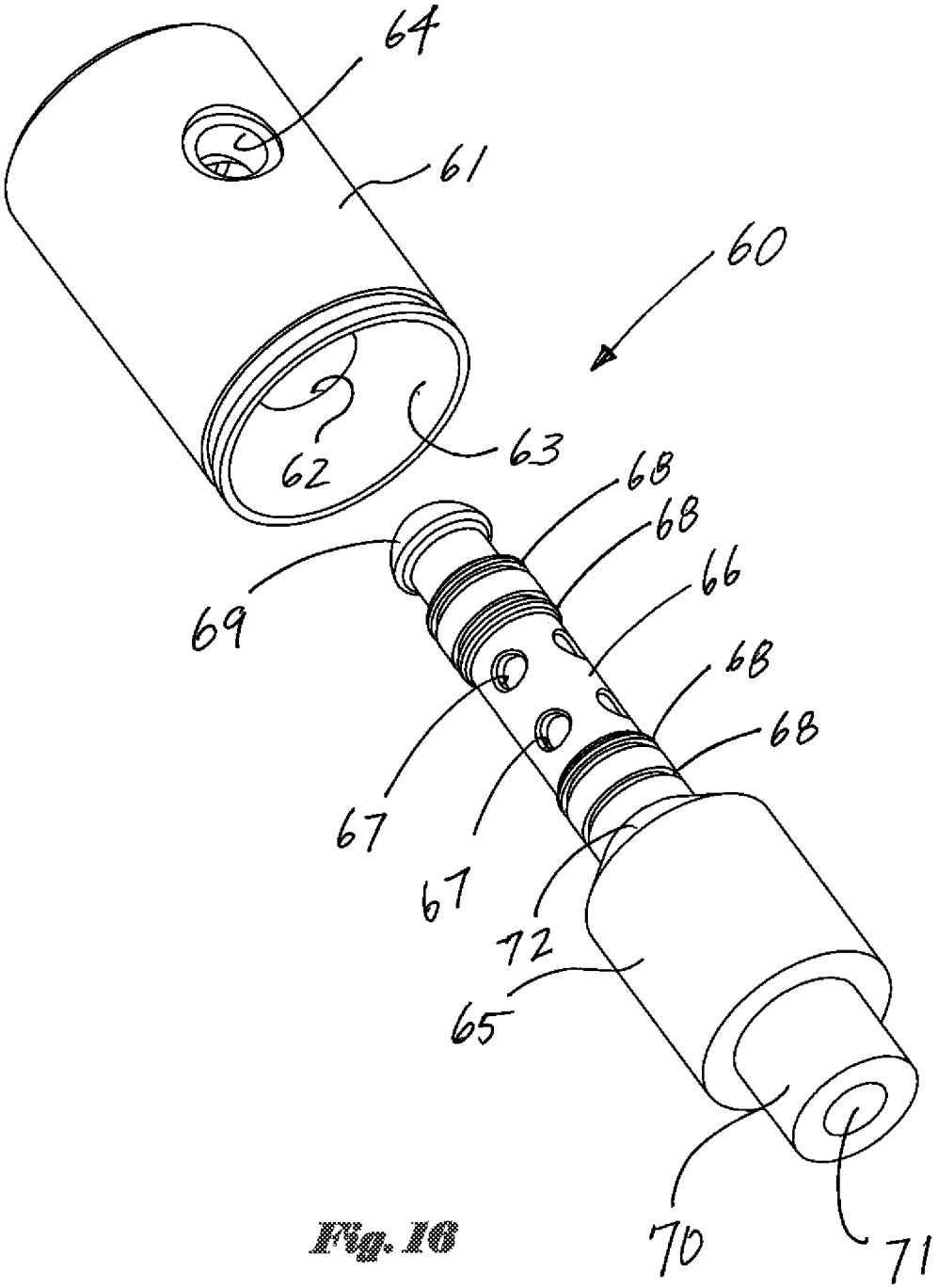
FIG. 16 depicts a partially exploded view of an alternative connection assembly of the present invention.

FIG. 16 depicts a partially exploded view of an alternative connection assembly 60 of the present invention. Said alternative connection assembly 60 comprises female connection receptacle member 61 having central through bore 62 and tapered shoulder 63. Said female connection receptacle member 61 further comprises side port 64.

Still referring to FIG. 16, alternative connection assembly 60 further comprises male stinger assembly 65 having stinger extension 66, lower extension 70 and central through bore 71. The outer diameter of stinger extension 66 is beneficially sized slightly smaller than central bore 62 of female receptacle member 61. At least one communication port 67 extends through stinger extension 66 and is in communication with said central through bore 71.

A plurality of fluid pressure sealing members 68 extend around the outer peripheral surface of stinger extension 66; although other materials or configurations can be contemplated, in a preferred embodiment said sealing members 68 comprise rubber or elastomeric sealing members. A head member 69 is disposed on the distal end of said stinger extension 66.

Figure 17:
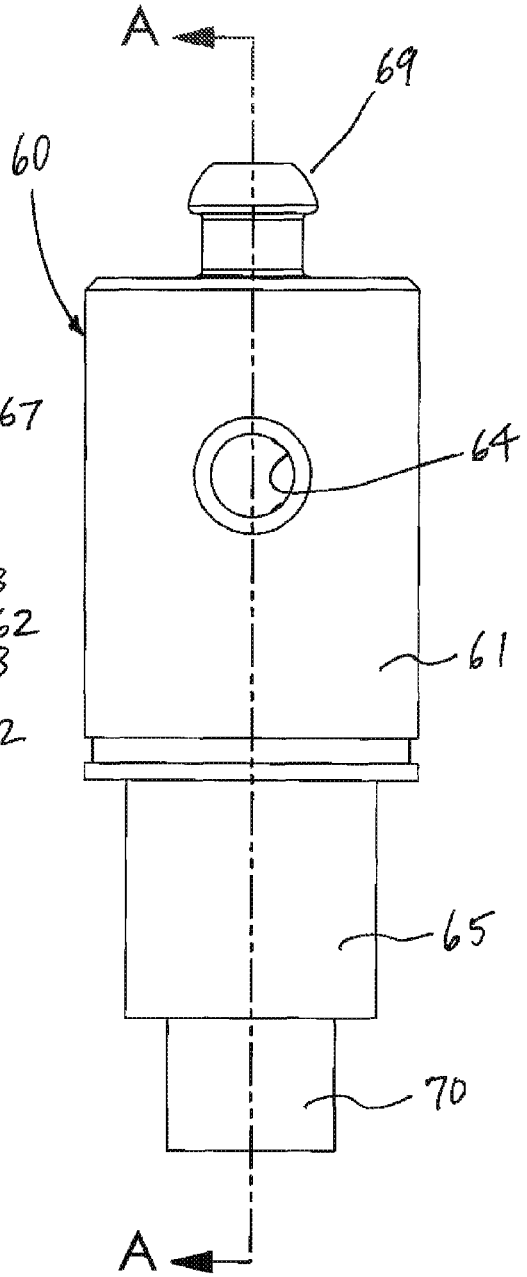
FIG. 17 depicts a side view of an alternative connection assembly of the present invention in a mating configuration.

FIG. 17 depicts a side view of an alternative connection assembly 60 of the present invention in a mating configuration. In such configuration, stinger extension 66 of male stinger assembly 65 is received within central bore 62 of female receptacle member 61. Head member 69, disposed on the distal end of said stinger extension 66, protrudes from an opening in the upper surface of female receptacle member 61.

Figure 18:
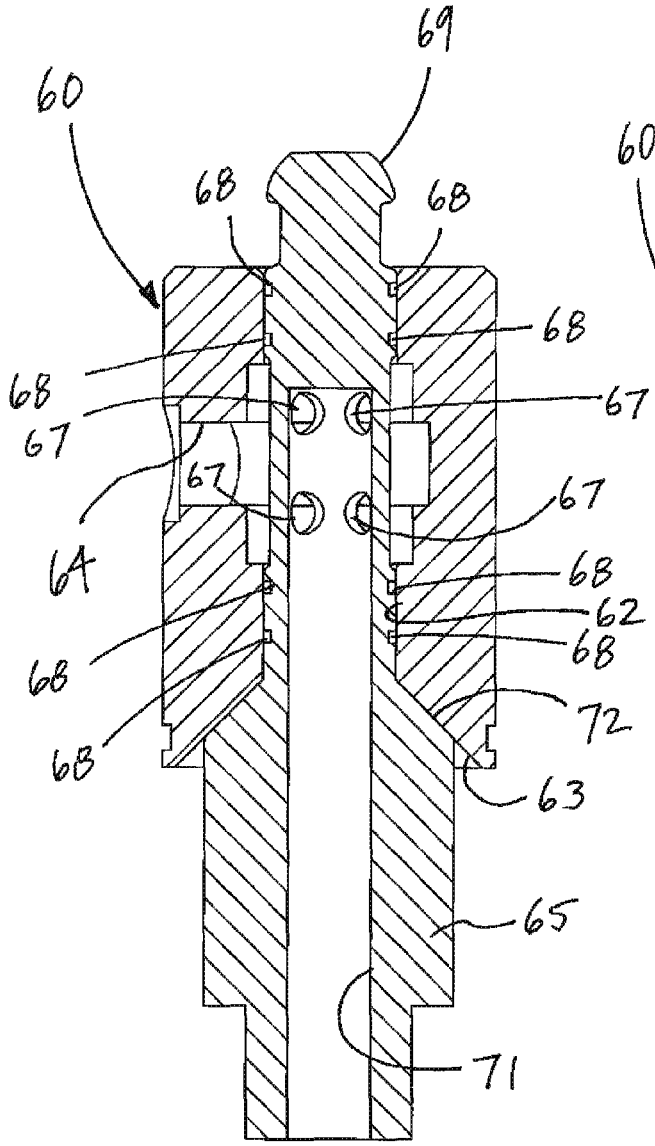
FIG. 18 depicts a side sectional view of an alternative connection assembly of the present invention in a mating configuration along line A-A of FIG. 17.

FIG. 18 depicts a side sectional view of an alternative connection assembly 60 of the present invention in a mating configuration along line A-A of FIG. 17. Female connection receptacle member 61 has central through bore 62 and tapered shoulder 63, as well as side port 64. Stinger extension 66 of male stinger assembly 65 is received within said central bore 62 of female receptacle member 61, while tapered shoulder 72 of male stinger assembly 65 conforms with and is received against tapered shoulder 63 of female connection receptacle member 61. Head member 69, disposed on the distal end of said stinger extension 66, protrudes from an opening in the upper surface of female receptacle member 61. A plurality of fluid pressure sealing members 68 extend around the outer peripheral surface of stinger extension 66, and engage against and form fluid pressure seals against the inner surface of central bore 62 of female receptacle member 61.

In operation, it is to be observed that male stinger assembly 65 can be connected to the distal end of a fluid conduit (such as, for example, a chiksan line 110 depicted in FIG. 1) while female connection receptacle member 61 can be disposed at or near a cement head assembly, with side port 64 of said female connection receptacle member 61 in fluid communication with a fluid inlet port of said cement head assembly.

The distal end of said fluid conduit equipped with said male stinger assembly 65 can be beneficially raised into proximity with said cement head using any of the alternative embodiment automated connection assemblies described herein. Said stinger extension 66 of male stinger assembly 65 can be received within said central bore 62 of female receptacle member 61, while tapered shoulder 72 of male stinger assembly 65 conforms with and is received against tapered shoulder 63 of female connection receptacle member 61.

In this manner, male stinger assembly 65 can engage with female receptacle member 61 to form a pressure-tight fluid connection. Said male stinger assembly 65 can be linearly stung in and attached to said female receptacle member 61 without requiring rotation; a locking device can be used to selectively grasp head member 69 which protrudes from an opening in the upper surface of female receptacle member 61 and prevent disengagement of said male stinger assembly 65 from female receptacle member 61.

With said components engaged as depicted in FIG. 18, cement slurry or other fluid can flow through a fluid conduit (such as, for example, chiksan line 110 depicted in FIG. 1), though central bore 71 of male stinger member 65, through communication ports 67 of said male stinger member 65 and out of side port 64 of female receptacle member 61. Said fluid flowing through said side port 64 can thereafter enter a fluid inlet port of a cement head assembly as described herein.

In a preferred embodiment, the automated connection assembly of the present invention can further comprise at least one safety pressure switch that senses the existence of an elevated fluid pressure across said connection, as well as controller safeguards that prevent disconnection in the event of such elevated pressure. Such safety means provide added protection against inadvertent or unwanted disconnection or separation of said connection members while under pressure.

Notwithstanding anything to the contrary contained herein, any and all dimensions or material selections described herein are illustrative only and are not intended to be, and should not be construed as, limiting in any manner.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A method for automated connection of a fluid conduit to a fluid inlet port of a cement head located at an elevated position above a rig floor comprising:

a) installing a lifting assembly on or in proximity to said cement head, wherein said lifting assembly further comprises:

i) a connection receiver in fluid communication with said fluid inlet port of said cement head; and ii) a winch assembly comprising:

aa) a winch drum rotatably disposed around said cement head and bb) a cable wrapped around said winch drum;

b) lifting a distal end of said fluid conduit having a stringer toward said cement head with said cable of said winch assembly until said stinger is at least partially received within said connection receiver;

c) actuating a locking assembly to secure said stinger to said connection receiver, wherein a fluid pressure seal is formed between said stinger and said connection receiver, and said locking assembly is controlled from a location away from said cement head;

d) pumping cement slurry through said fluid conduit, said connection receiver, and said fluid inlet port of said cement head;

e) sensing fluid pressure across said connection receiver; and f) preventing disconnection of said stringer from said connection receiver in the event that fluid pressure is sense.

2. The method of claim 1, wherein said cable extends from said winch assembly through a pulley assembly attached to said distal end of said fluid conduit, and wherein a distal end of said cable is anchored to said winch assembly.

3. The method of claim 1 wherein said fluid conduit comprises at least one chiksan.

4. The method of claim 1, wherein said lifting assembly further comprises a downwardly facing and substantially conical entry guide adapted to direct said stinger at least partially into said connection receiver.

5. The method of claim 1, wherein said winch of said lifting assembly is remotely controlled from a location away from said cement head.

6. The method of claim 1, wherein no personnel are lifted above said rig floor.

* * * * *